US009106992B2

(12) United States Patent
Takewa

(10) Patent No.: US 9,106,992 B2
(45) Date of Patent: Aug. 11, 2015

(54) LOUDSPEAKER AND ELECTRONIC EQUIPMENT INCLUDING THE LOUDSPEAKER

(71) Applicant: Panasonic Corporation, Osaka (JP)

(72) Inventor: Hiroyuki Takewa, Osaka (JP)

(73) Assignee: PANASONIC INTELLECUAL PROPERTY MANAGEMENT CO., LTD., Osaka (JP)

( * ) Notice: Subject to any disclaimer, the term of this patent is extended or adjusted under 35 U.S.C. 154(b) by 24 days.

(21) Appl. No.: 13/977,967

(22) PCT Filed: Oct. 23, 2012

(86) PCT No.: PCT/JP2012/006766

§ 371 (c)(1),
(2) Date: Jul. 2, 2013

(87) PCT Pub. No.: WO2013/076914

PCT Pub. Date: May 30, 2013

(65) Prior Publication Data

US 2014/0056467 A1 Feb. 27, 2014

(30) Foreign Application Priority Data

Nov. 24, 2011 (JP) ..... 2011-256229

(51) Int. Cl.
*H04R 1/00* (2006.01)
*H04R 9/02* (2006.01)
(Continued)

(52) U.S. Cl.
CPC ..... *H04R 9/025* (2013.01); *H04R 7/12* (2013.01); *H04R 9/046* (2013.01); *H04R 2209/022* (2013.01); *H04R 2209/041* (2013.01)

(58) Field of Classification Search
CPC ..... H04R 7/12; H04R 7/127; H04R 7/122; H04R 7/04; H04R 7/08; H04R 7/06
USPC ..... 381/403, 416, 424, 430
See application file for complete search history.

(56) References Cited

U.S. PATENT DOCUMENTS 2,998,496 A * 8/1961 Hassan ..... 381/416
4,595,801 A * 6/1986 Coffin ..... 381/424
(Continued)

FOREIGN PATENT DOCUMENTS

JP 57-078300 5/1982
JP 60-028400 2/1985
(Continued)

OTHER PUBLICATIONS

International Search Report mailed Jan. 22, 2013 in International (PCT) Application No. PCT/JP2012/006766.

*Primary Examiner* — Curtis Kuntz
*Assistant Examiner* — Ryan Robinson
(74) *Attorney, Agent, or Firm* — Wenderoth, Lind & Ponack, L.L.P.

(57) ABSTRACT

Provided is a loudspeaker having a thin long structure, and the loudspeaker includes: a frame; a diaphragm having a hollow structure and in which a shape of a plane that is perpendicular to a vibration direction is an oblong shape having a long side and a short side; an edge vibratably supporting the diaphragm and being fixed to the frame; at least one cylinder-shaped voice coil bobbin connected to the diaphragm in a penetrating manner; a voice coil disposed inside the hollow structure of the diaphragm and attached to the voice coil bobbin; and a magnetic circuit disposed inside the voice coil bobbin and configured to drive the voice coil.

13 Claims, 29 Drawing Sheets

(51) Int. Cl.
*H04R 7/12* (2006.01)
*H04R 9/04* (2006.01)

(56) References Cited

U.S. PATENT DOCUMENTS

| | | | | | |
|---|---|---|---|---|---|
| 4,868,882 | A | * | 9/1989 | Ziegenberg et al. | 381/407 |
| 4,899,390 | A | | 2/1990 | Takewa et al. | |
| 5,073,946 | A | | 12/1991 | Satoh et al. | |
| 5,371,806 | A | | 12/1994 | Kohara et al. | |
| 5,511,131 | A | | 4/1996 | Kohara et al. | |
| 5,664,024 | A | | 9/1997 | Furuta et al. | |
| 5,668,886 | A | | 9/1997 | Sakamoto et al. | |
| 5,862,242 | A | * | 1/1999 | Takewa et al. | 381/398 |
| 6,192,136 | B1 | * | 2/2001 | Azima et al. | 381/338 |
| 6,259,800 | B1 | | 7/2001 | Tagami | |
| 6,529,800 | B1 | * | 3/2003 | Johnson et al. | 700/236 |
| 7,185,735 | B2 | * | 3/2007 | Sahyoun | 181/157 |

FOREIGN PATENT DOCUMENTS

| | | |
|---|---|---|
| JP | 63-155997 | 6/1988 |
| JP | 1-98400 | 4/1989 |
| JP | 6-233384 | 8/1994 |
| JP | 6-284499 | 10/1994 |
| JP | 07-062719 | 3/1995 |
| JP | 7-298389 | 11/1995 |
| JP | 08-008905 | 1/1996 |
| JP | 2002-315093 | 10/2002 |

* cited by examiner

HOLLOW CIRCULAR SHAPE

FIG. 7

| CROSS-SECTIONAL SHAPE | HOLLOW SEMI-CIRCULAR SHAPE | HOLLOW CIRCULAR SHAPE |
|---|---|---|
| SECOND MOMENT OF AREA [$mm^4$] | 0. 6 | 4. 3 |
| TURNING RADIUS [mm] | 0. 7 | 1. 3 |
| CROSS-SECTIONAL AREA [$mm^2$] | 2. 5 | 4. 9 |

FIG. 8

| | | PRIMARY MODE | SECONDARY MODE | TERTIARY MODE |
|---|---|---|---|---|
| HOLLOW SEMI-CIRCULAR SHAPE (DIAPHRAGM 610)) | RESONANCE FREQUENCY (THEORETICAL VALUE) | 610Hz | 3298Hz | 8145Hz |
| | RESONANCE FREQUENCY (FEM VALUE) | 624Hz | 3295Hz | 7413Hz |
| | VIBRATIONAL MODE | | | |
| HOLLOW CIRCULAR SHAPE (DIAPHRAGM 110) | RESONANCE FREQUENCY (THEORETICAL VALUE) | 1154Hz | 6239Hz | 15407Hz |
| | RESONANCE FREQUENCY (FEM VALUE) | 1255Hz | 6395Hz | 14336Hz |
| | VIBRATIONAL MODE | | | |

200

300

300

540

640

600

LOUDSPEAKER AND ELECTRONIC EQUIPMENT INCLUDING THE LOUDSPEAKER

TECHNICAL FIELD

The present disclosure relates to a loudspeaker, and, more specifically, relates to a loudspeaker for the purpose of obtaining thinness.

BACKGROUND ART

In recent years, due to widespread use of so-called hi-vision and wide-vision televisions and the like, horizontally long television screens are becoming more general. On the other hand, due to housing circumstances in our country, television sets that are overall small-width and thin-shaped are preferred.

A loudspeaker unit (hereinafter, referred to as loudspeaker) for televisions is ordinarily attached on both sides of a display such as a plasma display or a liquid crystal display, and is a reason for enlarged width of a television set. Therefore, conventionally, a loudspeaker having a thin long structure such as square-shape and elliptical shape has been used for televisions. In addition, due to displays being shaped to be horizontally long, further reduction is demanded for the width of the loudspeaker. Furthermore, since the number of thin-screen televisions using plasma displays and liquid crystal displays has increased, further reduction in thickness of loudspeakers has been demanded. Further, corresponding to the screen being high definition, there is a demand for the loudspeaker to have high sound quality for audio.

Known Patent Literatures relevant to the present disclosure include, for example, Patent Literature 1. Patent Literature 1 discloses a conventional loudspeaker having a thin long structure.

CITATION LIST

Patent Literature

[PTL 1] Japanese Laid-Open Patent Publication No. 7-298389

SUMMARY OF THE INVENTION

Problems to be Solved by the Invention

However, in a conventional loudspeaker having a thin long structure, since a driving method of driving a central portion of a thin long diaphragm is adopted, break-up resonance regarding a long side direction of the diaphragm is easily generated. As a result, the frequency characteristic regarding reproduction sound pressure level becomes a characteristic having a peak dip in the mid to high range, leading to deterioration in sound quality. Furthermore, since it is necessary to adopt a shape having large depth (cone shape) for a diaphragm with the same opening size in order to make it difficult to have resonance generated in the long side direction, there has been a problem of not being able to reduce the depth of the loudspeaker.

The present disclosure has been made in view of the above described problem, and an objective is to provide a loudspeaker that has a thin long structure enabling reduction in thickness and has excellent sound quality.

Solution to the Problems

Provided is a loudspeaker having a thin long structure, and the loudspeaker includes: a frame; a diaphragm having a hollow structure and in which a shape of a plane that is perpendicular to a vibration direction is an oblong shape having a long side and a short side; an edge vibratably supporting the diaphragm and being fixed to the frame; at least one cylinder-shaped voice coil bobbin connected to the diaphragm in a penetrating manner; a voice coil disposed inside the hollow structure of the diaphragm and attached to the voice coil bobbin; and a magnetic circuit disposed inside the voice coil bobbin and configured to drive the voice coil.

Advantageous Effects of the Invention

With the present disclosure, it is possible to provide a thin loudspeaker having excellent sound quality and capable of obtaining a smooth frequency characteristic, and achieve reduction in thickness, even while having a thin long structure.

BRIEF DESCRIPTION OF THE DRAWINGS

FIG. 7 shows respective calculated values of second moment of area, turning radius, and cross-sectional area of hollow circular and hollow semi-circular cross-sectional shapes.

FIG. 8 shows results of analysis of resonance frequency in characteristic vibration mode of diaphragms having hollow circular and hollow semi-circular cross-sectional shapes.

DESCRIPTION OF EMBODIMENTS

Figure 21A:
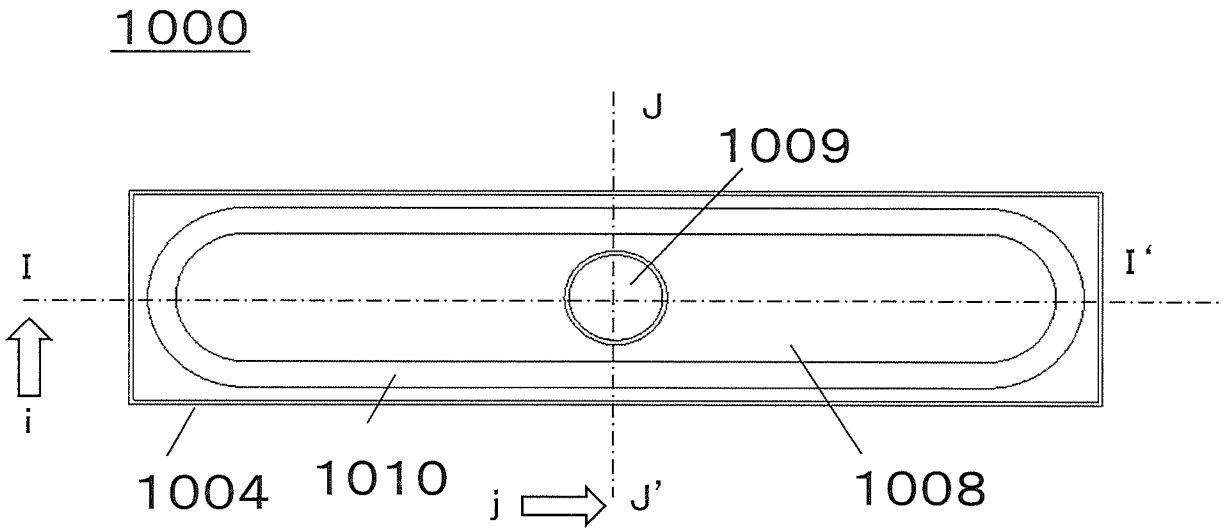
FIG. 21A PRIOR ART
FIG. 21A is a top view of a conventional loudspeaker.
Figure 21B:
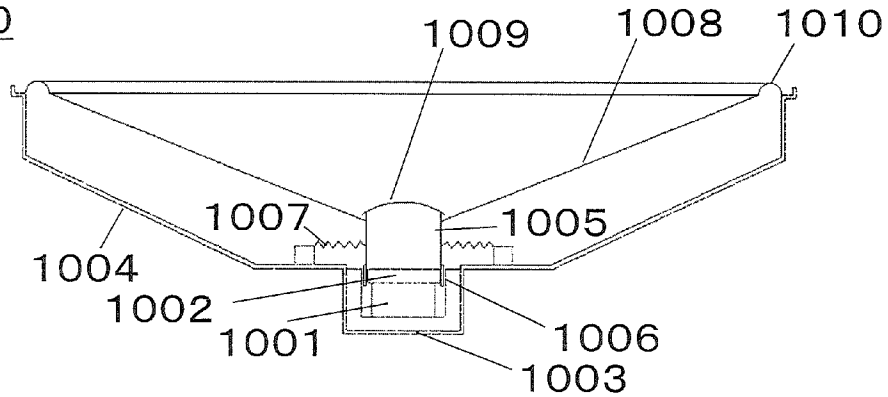
FIG. 21B PRIOR ART
FIG. 21B is a cross sectional view in direction I-I' in FIG. 21A.
Figure 21C:
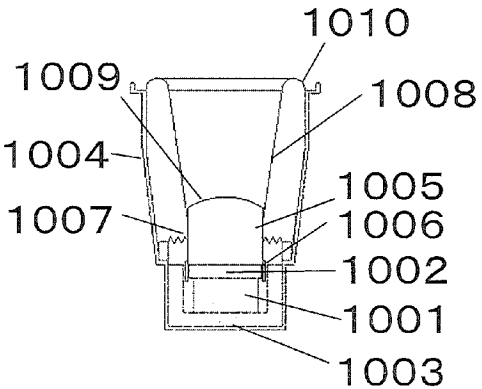
FIG. 21C PRIOR ART
FIG. 21C is a cross sectional view in direction J-J' in FIG. 21A.

A conventional loudspeaker having a thin long structure shown in Patent Literature 1 will be described with reference to the drawings. FIG. 21A is a plan view of a conventional loudspeaker 1000 having a thin long structure. Furthermore. FIG. 21B is a schematic diagram of a cross section cut along a long side direction (I-I') in FIG. 21A and viewed from arrow i. In addition, FIG. 21C is a schematic diagram of a cross section cut in a short side direction (J-J') and viewed from arrow j. The conventional loudspeaker 1000 having a thin long structure shown in FIGS. 21A to 21C includes a magnet 1001, a plate 1002, a yoke 1003, a frame 1004, a voice coil bobbin 1005, a voice coil 1006, a damper 1007, a diaphragm 1008, a dust cap 1009, and an edge 1010. In the following, description regarding the arrangement of main components will be provided.

The voice coil 1006 is a winding of a conductor such as copper and aluminum, and is attached on one end of the voice coil bobbin 1005 having a cylindrical shape. The voice coil 1006 is arranged in a magnetic gap formed, by the magnet 1001, between the plate 1002 and the yoke 1003. In addition, on the other end of the voice coil bobbin 1005, the diaphragm 1008 is attached. Furthermore, the voice coil bobbin 1005 is fixed by the damper 1007. The damper 1007 is connected to the frame 1004.

The plate 1002 is disposed inside the voice coil bobbin 1005, and is arranged at a part where the voice coil 1006 is attached. The magnet 1001 is arranged at a lower portion of the plate 1002, and the yoke 1003 is arranged so as to surround one portion of the magnet 1001.

The planar shape of the diaphragm 1008 is an ellipse or an approximately ellipse. In addition, the diaphragm 1008 has an inclination toward its center, i.e., a cone shape. As the material of the diaphragm 1008, a cone paper or the like is used. Furthermore, the dust cap 1009 is attached at the central part of the diaphragm 1008.

With regard to the edge 1010, its planar shape is annular, and its cross section is semi-circular. Furthermore, the inner circumference portion of the edge 1010 is attached to the outer circumferential portion of the diaphragm 1008, and the outer circumferential portion of the edge 1010 is attached to the frame 1004.

Next, motion of the conventional loudspeaker 1000 configured as described above and having the thin long structure will be described. When current is applied to the voice coil 1006, the voice coil bobbin 1005 makes a piston motion in the up-down direction when the dust cap is the upward direction in FIG. 21B, due to the current applied to the voice coil 1006 and the magnetic field around the voice coil 1006. With this piston motion, the diaphragm 1008 vibrates in the direction of the piston motion. As a result, sound waves radiate from the diaphragm 1008.

Figure 22:
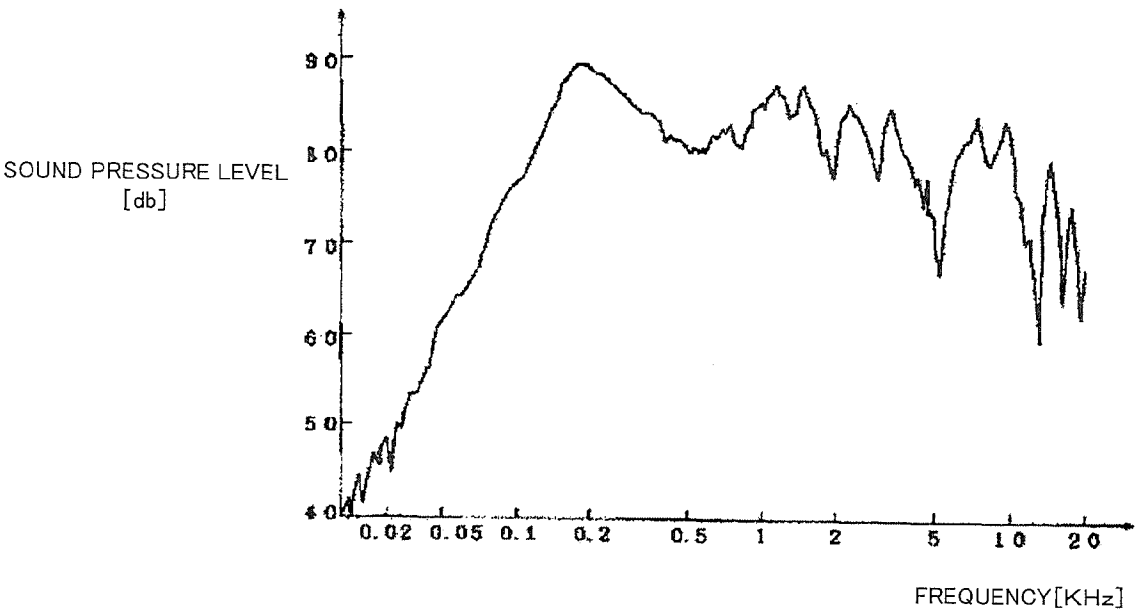
FIG. 22 PRIOR ART
FIG. 22 is a sound-pressure frequency characteristic diagram of a conventional loudspeaker.

FIG. 22 shows frequency characteristics regarding reproduction sound pressure level of the conventional loudspeaker 1000 having a thin long structure. In FIG. 22, the vertical axis represents reproduction sound pressure level when 1 W of power is inputted to the conventional loudspeaker 1000 having a thin long structure, and the horizontal axis represents driving frequency. It should be noted that a microphone for measuring reproduction sound pressure level is disposed on a central axis of the conventional loudspeaker 1000 having a thin long structure, and is arranged at a position 1 m away from the front side of the conventional loudspeaker 1000 having a thin long structure.

The conventional loudspeaker 1000 having a thin long structure has the following problem. Since the conventional loudspeaker 1000 having a thin long structure uses a driving method of driving the central portion of the thin long diaphragm 1008, break-up resonance regarding the long side direction can be easily generated. As a result, the frequency characteristic regarding reproduction sound pressure level becomes a characteristic having a peak dip in the mid to high range, leading to deterioration in sound quality. For example, in the characteristic shown in FIG. 22, significant dips can be observed near 2 kHz, 3 kHz, and 5 kHz.

The depth of the diaphragm 1008 is set to be large (cone shape) in order to make it difficult to have resonance generated in the long side direction. Thus, the diaphragm 1008 has a shape having height in the up-down direction in FIG. 21B. In order to prevention contact when the diaphragm 1008 vibrates, since it is necessary to provide distance between the damper 1007 and the frame 1004, distance between the diaphragm 1008 and the damper 1007 and magnetic circuits such as the yoke 1003 and the plate 1002, the damper 1007 is attached near the center of the voice coil bobbin 1005. More specifically, the diaphragm 1008, the upper portion of the voice coil bobbin 1005, the damper 1007, the lower portion of the voice coil bobbin 1005, the magnet 1001, the plate 1002, and the yoke 1003 are disposed so as to be separated from each other in the vibration direction (up-down direction in FIG. 21B). Due to such configuration, it is not possible to reduce the depth of the loudspeaker.

Therefore, the present inventors obtained an original idea of a structure of a thin loudspeaker having excellent sound quality, capable of obtaining a smooth frequency characteristic, and achieve reduction in thickness, since break-up resonance is unlikely to occur and generation of peak dips is suppressed even while having a thin long structure.

Various modes of the present disclosure based this original idea will be described in the following.

A loudspeaker in one mode of the present disclosure includes: a frame; a diaphragm having a hollow structure and in which a shape of a plane that is perpendicular to a vibration direction is an oblong shape having a long side and a short side; an edge vibratably supporting the diaphragm and being fixed to the frame; at least one cylinder-shaped voice coil bobbin connected to the diaphragm in a penetrating manner; a voice coil disposed inside the hollow structure of the diaphragm and attached to the voice coil bobbin; and a magnetic circuit disposed inside the voice coil bobbin and configured to drive the voice coil.

Since this mode does not have a structure in which respective components are piled up in the thickness direction of the loudspeaker, but has a structure in which respective components are arranged so as to be overlapped and nested in another component inside a hollow structure of a diaphragm, it is possible to achieve reduction in thickness.

In another mode, for example, the voice coil is attached so as to be arranged at a position that equally divides a height of the voice coil bobbin; and a barycenter of the voice coil, a point at which the edge is fixed to the frame, a barycenter of the diaphragm, and a barycenter of the magnetic circuit are arranged on an identical plane.

With this other mode, rotational moment of a vibration system can be minimized, and anti-rolling characteristics can be improved.

Furthermore, in another mode, the loudspeaker includes a conductive line connecting a terminal disposed on the frame and an eyelet secured at a terminal part of the diaphragm in a long side direction thereof, and a lead line connecting the eyelet and the voice coil, and the lead line may be attached inside the diaphragm.

With this other mode, it is possible to provide an excellent loudspeaker without any distortions by preventing disconnection of the lead line due to abnormal resonance and resonance vibration. Furthermore, since it is not necessary to provide space larger than a vibrational amplitude margin for preventing contact with the frame, it is possible to reduce the thickness of the loudspeaker.

Furthermore, in another mode, the magnetic circuit may have a configuration in which two magnets are attached to each other in a repelling direction, and a cross-sectional shape in a short side direction of the diaphragm may be a circular shape, an elliptical shape, a hollow trapezoidal shape, or a hollow polygonal shape.

Furthermore, in another mode, for example, the loudspeaker may include two of the voice coil bobbins, and the voice coil bobbins may each be disposed at a position of a node in a primary resonance mode in the long side direction of the diaphragm. Furthermore, the loudspeaker may include four of the voice coil bobbins, and the voice coil bobbins may each be disposed at a node in a primary resonance mode and a secondary resonance mode in the long side direction of the diaphragm.

With these other modes, since driving points of the diaphragm are disposed at positions suppressing the primary and secondary resonance modes, it becomes possible to broaden a reproduction frequency band.

Furthermore, as other modes of the present disclosure, it is also conceivable to use an auxiliary plate and auxiliary magnets for the magnetic circuit of the loudspeaker, shape both ends of the diaphragm in the long side direction as a semi-spherical shape, or include the loudspeaker in electronic equipment.

Hereinafter, embodiments will be described in detail with reference to the drawings as appropriate. However, there will be instances in which detailed description beyond what is necessary is omitted. For example, detailed description of subject matter that is previously well-known, as well as redundant description of components that are substantially the same will in some cases be omitted. This is to prevent the following description from being unnecessarily lengthy, in order to facilitate understanding by a person of ordinary skill in the art. The applicant provides the following description and the accompanying drawings in order to allow a person of ordinary skill in the art to sufficiently understand the present disclosure, and the description and the drawings are not intended to restrict the subject matter of the scope of the patent claims.

Embodiment 1

Figure 1A:
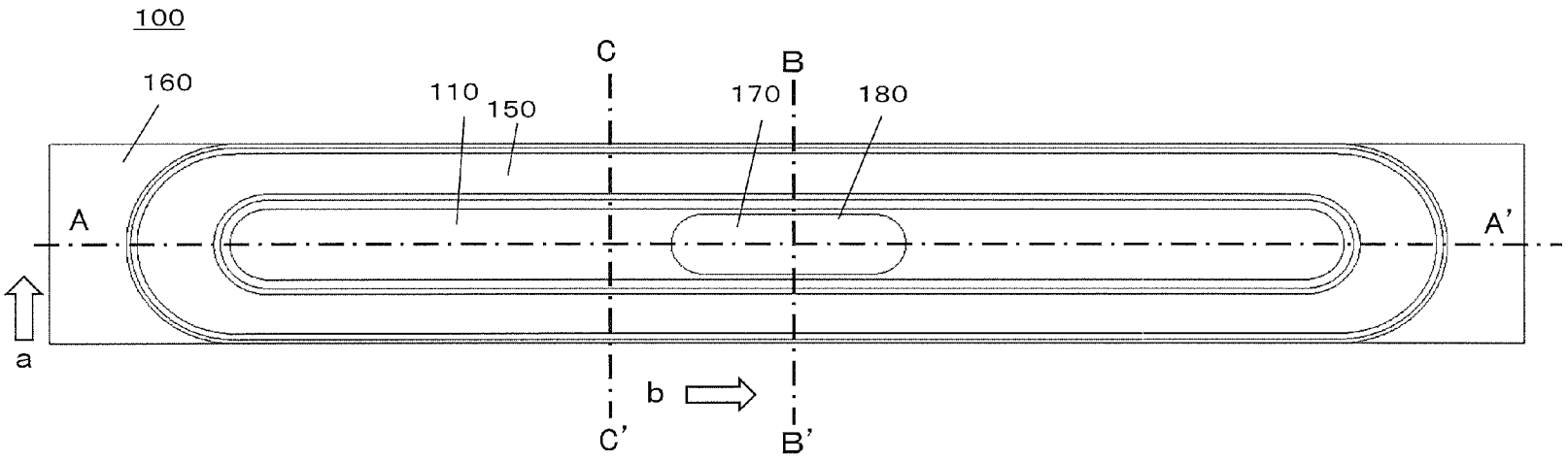
FIG. 1A is a top view of a loudspeaker in Embodiment 1.
Figure 1B:
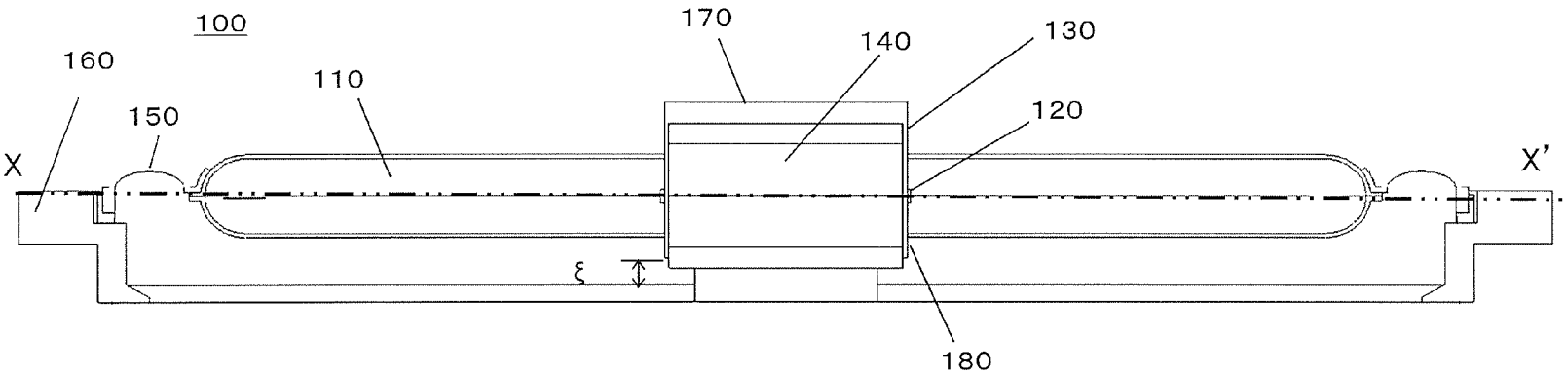
FIG. 1B is a schematic diagram of a cross section cut along line A-A' in FIG. 1A.
Figure 1C:
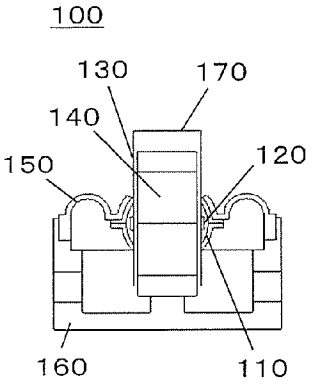
FIG. 1C is a schematic diagram of a cross section cut along B-B' in FIG. 1A.

In the following, description of Embodiment 1 will be provided. First, the configuration of a loudspeaker 100 in the present embodiment will be described. FIG. 1A is a top view of the loudspeaker 100 according to the present embodiment. FIG. 1B is a schematic diagram of a cross section cut along line A-A' in FIG. 1A and viewed from a direction of arrow a. FIG. 1C is a schematic diagram of a cross section cut along line B-B' in FIG. 1A and viewed from a direction of arrow b.

The loudspeaker 100 includes a diaphragm 110, a voice coil 120, a voice coil bobbin 130, a magnetic circuit 140, an edge 150, a frame 160, and a dust cap 170. As shown in FIG. 1A, the loudspeaker 100 has a thin long shape whose lengths in the longitudinal direction and the horizontal direction are different. In the following, each component of the loudspeaker 100 will be described.

Figure 2A:
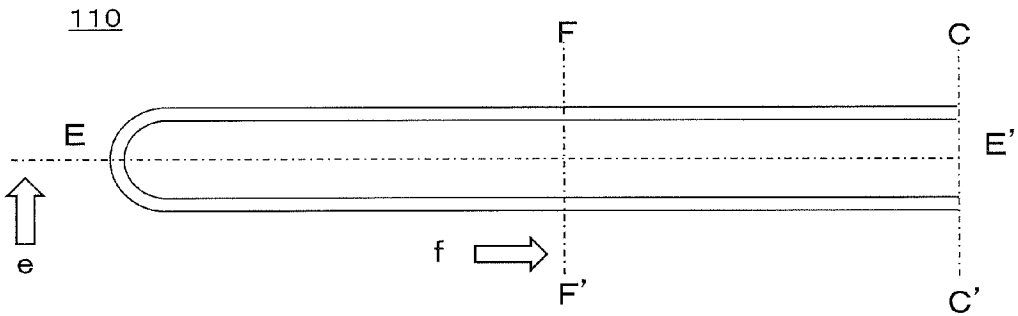
FIG. 2A is a top view of a diaphragm in Embodiment 1.
Figure 2B:
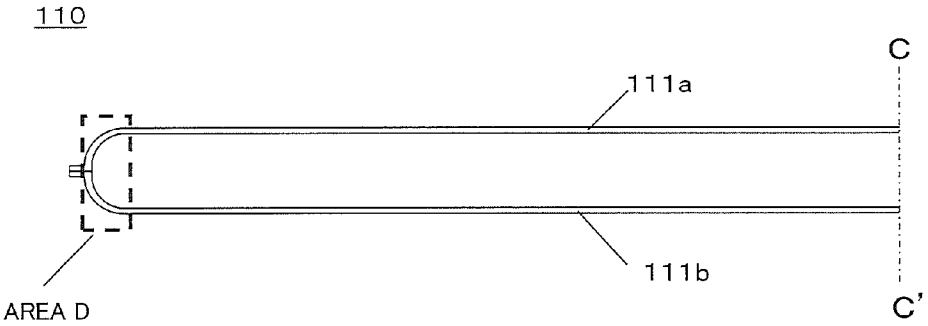
FIG. 2B is a schematic diagram of a cross section cut along line E-E' in FIG. 2A.
Figure 2C:
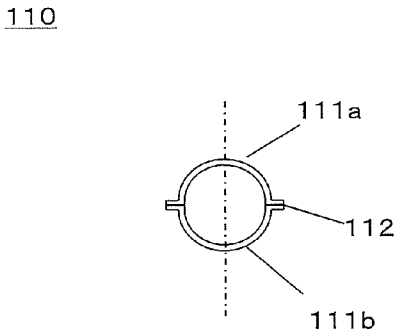
FIG. 2C is a schematic diagram of a cross section cut along line F-F' in FIG. 2A.

First, description of the diaphragm 110 will be provided. FIG. 2A is a plan view of the diaphragm 110, and description of the left side of line C-C' in FIG. 1 will be provided. FIG. 2B is a schematic diagram of a cross section cut along line E-E' in FIG. 2A and viewed from a direction of arrow e. FIG. 2C is a schematic diagram of a cross section cut along line F-F' in FIG. 2A and viewed from a direction of arrow f. As shown in FIG. 2A, the planar shape of the diaphragm 110 when viewed from a vibration direction (a direction perpendicular to the paper surface in FIG. 2A) has a long side and a short side. Furthermore, as shown as area D in FIG. 2B, both ends of the diaphragm 110 in the long side direction have a hollow semi-spherical shaped structure. In addition, as shown in FIG. 2C, the cross-sectional shape of the diaphragm 110 in its short side direction is a hollow circular shape. Further, as shown in FIG. 2C, the diaphragm 110 is obtained by pasting together a diaphragm 111*a* on the top side and a diaphragm 111*b* on the bottom side, each of which having a thin long track with an adhesion margin 112 at a terminal part of a semi-circular shaped cross-section in the short side direction. It should be noted that as long as the diaphragm 110 has a cross-sectional shape as described above, the diaphragm 110 does not necessarily have to be one that is obtained by pasting together the diaphragm 111*a* and the diaphragm 111*b* having the thin long tracks. Furthermore, as shown in FIG. 1A, the diaphragm 110 has a penetration hole 180 for attaching thereto the voice coil bobbin 130. When a shape in which the diaphragm 111*a* and the diaphragm 111*b* are pasted together as in the present embodiment is used, the penetration hole 180 is provided both on the diaphragm 111*a* and the diaphragm 111*b*.

The material of the diaphragm 110 is preferably light-weight in order to be suitable for thickness reduction, and usage of a paper or a high polymer film etc., is most preferable. However, as the material of the diaphragm 110, a light-weight high-rigidity metallic foil such as aluminum and titanium may be used.

Figure 3:
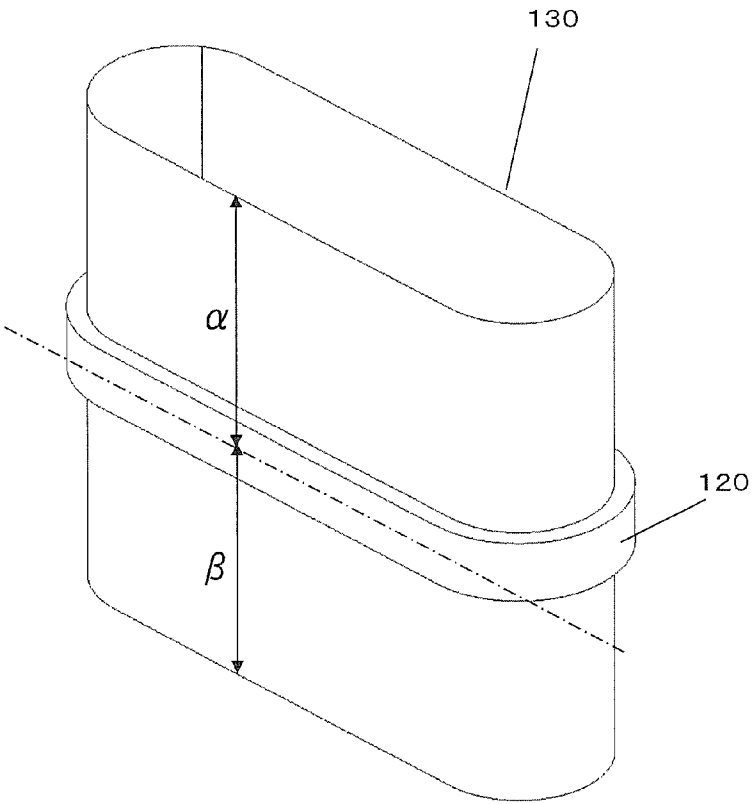
FIG. 3 is a perspective view of a voice coil and a voice coil bobbin in Embodiment 1.

Next, description regarding the voice coil 120 and the voice coil bobbin 130 will be provided. FIG. 3 is a perspective view of the voice coil 120 and the voice coil bobbin 130. The voice coil 120 is obtained by winding, for multiple times, and attaching, on a side surface of the cylindrical voice coil bobbin 130 whose cross section is an oval shape, an insulated thin wire formed from copper or aluminum. In addition, the voice coil 120 is arranged at a midpoint on the side surface of the voice coil bobbin 130. Therefore, the voice coil 120 is wound and attached on the side surface of the voice coil bobbin 130, such that a distance $\alpha$ from the top end part of the voice coil bobbin 130 to a line equally dividing the height of the voice coil 120 shown in FIG. 3 and a distance $\beta$ from the bottom end part of the voice coil bobbin 130 to the line equally dividing the height of the voice coil 120 are equal.

Figure 4:
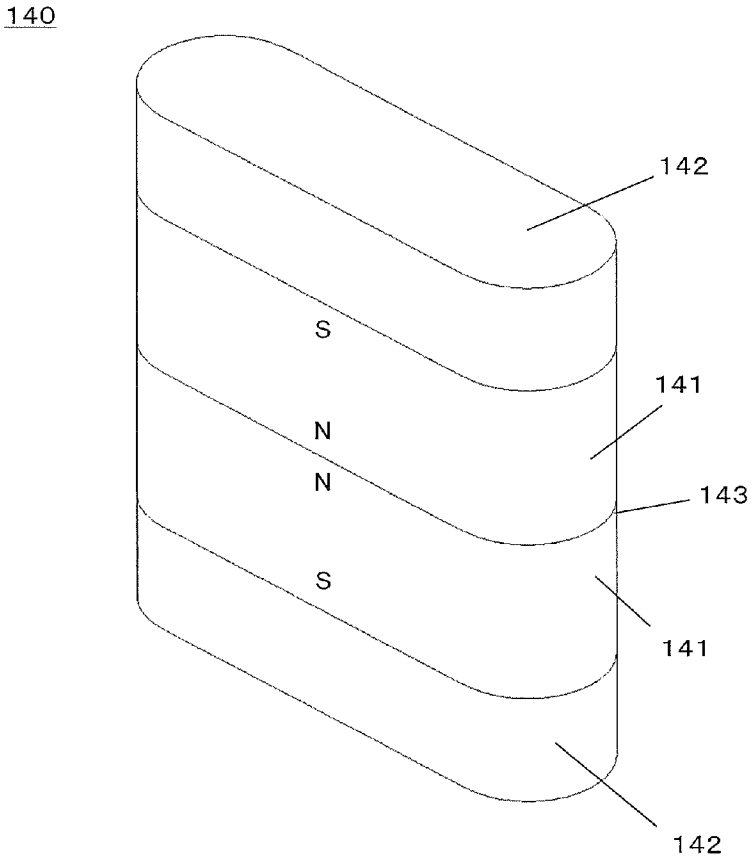
FIG. 4 is a perspective view of a magnetic circuit in Embodiment 1.

Next, description regarding the magnetic circuit 140 will be provided. FIG. 4 is a perspective view of the magnetic circuit 140. The size of the magnetic circuit 140 is smaller, by the size of a gap, than the internal diameter of the voice coil bobbin 130 in order to place the magnetic circuit 140 inside the voice coil bobbin 130. The outside diameter shape of the magnetic circuit 140 is similar to the shape of the voice coil bobbin 130. Furthermore, the magnetic circuit 140 includes two polarized magnets 141 attached to each other in a repelling direction. Each of the magnets 141 has a plate 142 attached on its surface opposite to the surface where the magnets 141 are attached to each other. Shown in FIG. 4 with letter N or S is an example of the polarization direction of the magnets 141. The polarities of N and S are set to obtain mutual repelling polarities, and are reversible. It should be noted that, generated magnetic flux emerges from a joint surface 143 of the two magnets 141 in a horizontal direction, and then reaches the plates 142 while repelling other flux in a mutual manner. Furthermore, the magnetic circuit 140 is attached to the frame 160 by having an end surface of one of the plates 142 attached to the frame 160.

Next, description regarding the edge 150 will be provided. As shown in FIG. 1A, the planar shape of the edge 150 is annular. Furthermore, as shown in FIG. 1B and FIG. 1C, the edge 150 has an approximately semi-circular shaped or approximately half-elliptical shaped cross section that is orthogonal to the vibration direction (up-down direction when the dust cap 170 is disposed on the upward direction in FIGS. 1B and 1C). An inner circumference of the edge 150 is attached to an outer circumference of the diaphragm 110.

Next, description regarding the frame 160 will be provided. As shown in FIGS. 1A to 1C, the frame 160 has an annular shape having an opening. As shown in FIGS. 1A to 1C, the opening of the frame 160 is attached to the outer circumference of the edge 150.

Next, description regarding the dust cap 170 will be provided. As shown in FIGS. 1B and 1C, the dust cap 170 is disposed at the top end of the voice coil bobbin 130. The dust cap 170 passes through the penetration hole 180, and blocks sound that are to be released from the top surface of the voice coil bobbin 130 in the vibration direction.

Figure 5:
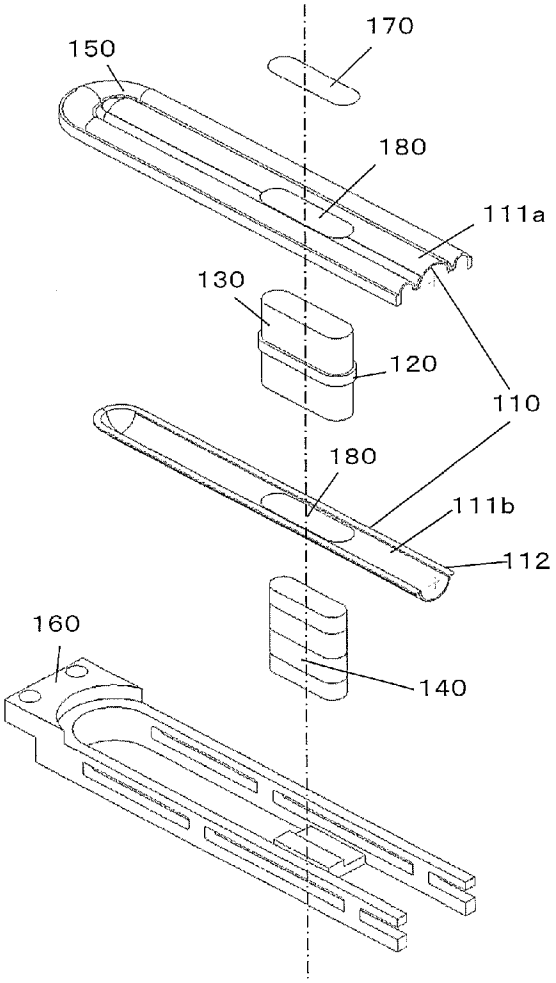
FIG. 5 is a component constitution perspective view of the loudspeaker in Embodiment 1.

Next, description regarding component constitution of the loudspeaker 100 will be provided. FIG. 5 is a component constitution perspective view of the loudspeaker 100 of the present embodiment.

As shown in FIGS. 1B and 1C, the voice coil bobbin 130 is inserted in the penetration hole 180 of the diaphragm 110. Furthermore, a point at which the edge 150 is fixed to the frame 160, a barycenter of the diaphragm 110, a barycenter of the voice coil 120, and a barycenter of the magnetic circuit 140 are arranged on an identical plane. In the present embodiment, those described above are arranged inside a toric cross section of the diaphragm 110 and on a central plane (surface of X-X' in FIG. 1B) of the diaphragm 110 orthogonal to the vibration direction.

Next, description will be provided regarding the motion and advantageous effect of the loudspeaker 100 formed as described above. When current is applied to the voice coil 120, driving force is generated on the voice coil 120 by the applied current and magnetic field created by the magnetic circuit 140. The generated driving force is transferred to the diaphragm 110 via the voice coil bobbin 130. Vibration of the diaphragm 110, to which the driving force is transferred, causes sound to radiate to external space.

Next, from a standpoint of theory and simulation, description will be provided regarding advantageous effects of the diaphragm 110 formed as described above when its cross-sectional shape in the short side direction is a hollow semi-circular shape or a hollow circular shape as in the present disclosure. First, description will be provided from a standpoint of theory.

The diaphragm 110 is ordinarily supported at its outer circumference by the edge 150, and thus can be approximately regarded as a rod whose ends on both sides are free. Therefore, from the theory of the vibrational mode of a rod having free ends on both sides thereof, it is possible to discuss about resonance frequency of its vibrational mode and changes of rigidity depending on cross-sectional shape. Here, description will be provided regarding the theory of the vibrational mode of a rod having free ends on both sides thereof. The following formula (1) shows resonance frequency formula of the vibrational mode of a rod having free ends on both sides thereof.

[Math. 1]

$$f_1 \propto \frac{1.133\pi}{l^2}\sqrt{\frac{QK^2}{\rho}} \text{ (Fundamental Frequency)} \tag{1}$$

$$f_n \propto \frac{\pi}{8l^2}\sqrt{\frac{QK^2}{\rho}}\,(2n+1)^2 \text{ (when } n \geq 2)$$

Here, l represents the length of the rod, ρ represents density, Q represents Young's modulus of the material, and K represents turning radius.

Figure 6A:
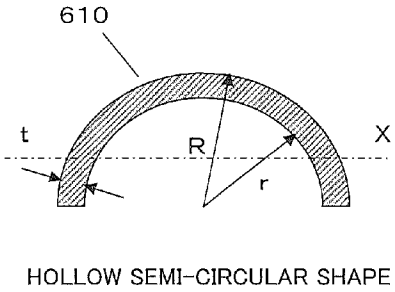
FIG. 6A is a cross-sectional shape model view of a hollow semi-circular shape.

In formula (1) described above, the turning radius K is different depending on the cross-sectional shape. FIG. 6A shows a hollow semi-circular shaped cross section of a diaphragm 610, and FIG. 6B shows a hollow circular shaped cross section of the diaphragm 110 of the present embodiment.

Figure 6B:
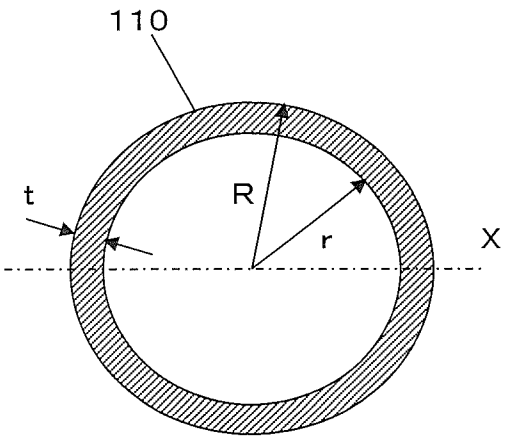
FIG. 6B is a cross-sectional shape model view of a hollow circular shape.

Description of turning radius with respect to each of the cross-sectional shapes will be provided using FIG. 6A and FIG. 6B. First, description of the hollow semi-circular shaped cross section in FIG. 6A will be provided. According to the theorem of second moment of area, the second moment of area of a pictorial figure having a hollow cross-section such as a tube or a tunnel can be obtained by subtracting the second moment of area of the pictorial figure of the hollow part from the second moment of area of the pictorial figure of the outer side thereof. Although the position of the center of the pictorial figure of the outer side is different from the center of the pictorial figure of the inner side with respect to a reference axis used when obtaining a cross-sectional moment; it is possible to consider the radii of the outer semi-circle and the inner semi-circle to be approximately equal in the case of a hollow semi-circular shaped cross section as with the diaphragm 610 since the thickness of the diaphragm 610 is very small. Therefore, the second moment of area of the hollow semi-circular shape can be considered as the difference between the respective second moments of areas of the outer semi-circle and the inner semi-circle. The following formula (2) shows the second moment of area of a semi-circle that is not hollow, the following formula (3) shows the second moment of area when the cross section is a hollow semi-circular shape, and the following formula (4) shows its cross-sectional area.

[Math. 2]

$$\left(\frac{\pi}{8} - \frac{8}{9\pi}\right) r_{semi}^4 \tag{2}$$

Here, $r_{semi}$ represents the radius of a semi-circle that is not hollow.

[Math. 3]

$$\left(\frac{\pi}{8}-\frac{8}{9\pi}\right)(R^4-r^4) \tag{3}$$

Here, R represents the radius of the outer semi-circle, and r represents the radius of the inner semi-circle.

[Math. 4]

$$\frac{\pi}{2}(R^2-r^2) \tag{4}$$

In addition, since the turning radius is the square root of the quotient obtained by dividing the second moment of area with cross-sectional area, the turning radius of a shape whose cross section is hollow semi-circular is obtained by the following formula (5).

[Math. 5]

$$\sqrt{\left(\frac{1}{4}-\frac{16}{9\pi^2}\right)\left(\frac{R^4-r^4}{R^2-r^2}\right)} \tag{5}$$

With regard to the case with a hollow circular shape, since it is possible to calculate the second moment of area and turning radius with the similar approach, formulae for that case will be shown but description will be omitted. The following formula (6) shows the second moment of area of a shape whose cross-sectional shape is a hollow circular shape, the following formula (7) shows its turning radius, and the following formula (8) shows its cross-sectional area.

[Math. 6]

$$\frac{\pi}{4}(R^4-r^4) \tag{6}$$

Here, R represents the radius of the outer semi-circle, and r represents the radius of the inner semi-circle.

[Math. 7]

$$\frac{\sqrt{R^2+r^2}}{2} \tag{7}$$

[Math. 8]

$$\pi(R^2-r^2) \tag{8}$$

FIG. 7 shows respective values calculated using the above described formulae (3) to (8) for the second moments of area, turning radius, cross-sectional area of the shapes whose cross section are hollow circular and hollow semi-circular. In FIG. 7, results calculated using R=2 mm, r=1.8 mm, and t=0.2 mm, are shown.

Next, by using the calculated values in FIG. 7, the change in resonance frequency and the change in rigidity caused by changing the cross-sectional shape from a hollow semi-circular shape to a hollow circular shape are examined.

From formula (1) described above, it can be understood that, when the length of the rod and the material constant are constant, the change in resonance frequency due to the change in the cross-sectional shape is proportional to the turning radius. In addition, since rigidity (flexural rigidity) of the rod is represented by a product of the second moment of area and the Young's modulus of the material of the rod, it can be understood that rigidity of the rod is proportional to the second moment of area.

Therefore, when the cross-sectional shape is changed from a hollow semi-circular shape to a hollow circular shape, it can be understood that, the turning radius becomes approximately 1.9 times from the above described formulae (5) and (7), the second moment of area becomes approximately 7.2 times from the above described formulae (2) and (6), the resonance frequency becomes approximately 1.9 times higher, and rigidity becomes improved approximately 7.2 times.

Next, based the above described theoretical results, FIG. 8 shows the result of analyzing resonance frequency of the characteristic vibration mode using Finite Element Method (FEM) incorporated with the actual geometric models of the diaphragm 110 and the diaphragm 610 described in the present embodiment. In FIG. 8, the resonance frequency (theoretical value) is the result calculated using the above described formula (1).

In FIG. 8, evaluation is conducted only for resonance modes having even number of nodes. Furthermore, a resonance whose number of nodes is 2 is represented as the primary mode, and a case where the number of nodes is 4 is represented as the secondary mode. This is because, disturbance of sound pressure due to the resonance mode is offset on the axis when there are odd number of nodes in the resonance mode contributing to sound pressure, whereas a peak dip is generated only when there are even number of nodes. From FIG. 8, it can be understood that the theoretical calculation value (theoretical value) and the simulation analysis value (FEM value) match well. Furthermore, when compared to the resonance frequency of the diaphragm 610 whose cross-sectional shape is a semi-circular shape, it can be understood that the resonance frequency of the diaphragm 110 whose cross-sectional shape is a circular shape is approximately 2 times higher. From this simulation result of frequency change, the change of rigidity caused by the change of cross-sectional shape of the diaphragm from a semi-circular shape to a circular shape is back-calculated.

From the above described formula (1), resonance frequency is proportional to turning radius. Furthermore, since turning radius is a square root of a quotient of the second moment of area and cross-sectional area, the second moment of area is proportional to a product the cross-sectional area and a square of turning radius. Therefore, it can be understood from FIG. 8 that, when the cross-sectional shape of the diaphragm is changed from a semi-circular shape to a circular shape, the change in turning radius is approximately 2 times and the cross-sectional area is also 2 times, and therefore rigidity becomes approximately 8 times.

As described above, by setting the cross-sectional of the diaphragm in the long side direction to be a hollow circular shape, it is possible to improve rigidity of the diaphragm in the long side direction, and increase resonance frequency of the mode. With this, it is possible to reduce the number of influential resonance frequency in the important audio band.

It should be noted that, in the present embodiment, although description has been provided regarding the diaphragm 110 whose cross section in the short side direction is a circular shape, it is possible to further increase rigidity when the cross-sectional shape of the diaphragm 110 in the short side direction is elliptical. Furthermore, the cross-sectional shape of the diaphragm 110 in the short side direction may be a hollow trapezoidal shape or a hollow polygonal shape.

Next, description regarding reduction in thickness will be provided. In the conventional loudspeaker 1000 having a thin long structure, rigidity thereof is increased by having a large depth for the diaphragm 1008 formed from a cone paper or the like. Therefore, since a diaphragm formed from a cone paper or the like having a large depth is required for reproduction up to high frequency, it is difficult to obtain a thin loudspeaker. On the other hand, by using the diaphragm 110 whose cross section has a hollow circular shape to increase the second moment of area, rigidity is increased. In the diaphragm 110 whose cross-sectional shape is a hollow circular shape and has the resonance frequency set forth in FIG. 8, the radius of the cylinder is 2.0 mm, and the overall height of the diaphragm 110 is about 4.0 mm. In a general cone type diaphragm as in the case with the diaphragm 1008, an overall height (depth) of approximately about 20 to 30 mm is necessary for the hollow circular shaped diaphragm 110 shown in FIG. 8 to achieve a frequency of 1255 Hz which is the resonance frequency in the primary mode.

In addition, the loudspeaker 100 of the present embodiment achieves further reduction in thickness by the following manner.

In the conventional loudspeaker 1000 having a thin long structure, the voice coil 1006 is connected to a terminal part of the diaphragm 1008 in the depth direction via the voice coil bobbin 1005. Thus, the voice coil bobbin 1005 and the voice coil 1006 are arranged in a state of being vibratably hung on the magnetic circuit by the edge 1010 and the damper 1007. The magnetic circuit including the magnet 1001 and the like is arranged further behind (lower portion in FIG. 21B) the voice coil 1006. Therefore, in a conventional loudspeaker, the thickness of the loudspeaker is the thickness resulting from piling up the diaphragm 1008, the voice coil bobbin 1005, the voice coil 1006, and the magnetic circuit including the magnet 1001 etc. For example, in a case where the depth of the diaphragm 1008 is 20 mm, the winding width of the voice coil is 2.0 mm, vibrational margin width is 2.0 mm, and the magnetic circuit is 10 mm, the depth of the loudspeaker has to be larger equal to or larger than the thickness of 20+2+2+10=34 mm.

On the other hand, in the loudspeaker 100 of the present embodiment, the penetration hole 180 is formed on the diaphragm 110 so as to arrange the voice coil 120 and the voice coil bobbin 130 inside the diaphragm 110. Furthermore, since the magnetic circuit 140 is arranged inside the voice coil bobbin 130, instead of having a structure in which respective components are piled up in the thickness direction of the loudspeaker 100, a structure is obtained in which respective components are arranged so as to be overlapped and nested in another component such that connection surface of the diaphragm 110 is the central plane (surface X-X' in FIG. 1B). Therefore, when compare to a conventional loudspeaker, an extremely thin loudspeaker can be achieved. When the surface of X-X' in FIG. 1B is used as a boundary, the thickness of the loudspeaker 100 is a result of: in the top side of the vibration direction, ½ of the thickness of the voice coil bobbin 130; and, in the bottom side of the vibration direction, ½ of the thickness of the voice coil bobbin 130, a vibrational margin width (shown as ξ in FIG. 1B) provided such that the voice coil bobbin 130 and the frame 160 do not make contact with each other, and the thickness of the adhesion surface of the frame 160 to which the magnetic circuit 140 is attached. For example, when the vibrational margin width is 2.0 mm, it is possible to have a configuration in which the thickness of the voice coil bobbin 130 is 7 mm and the thickness of the frame is 2.0 mm to obtain a total thickness of 11 mm for the loudspeaker 100.

Next, description will be provided regarding anti-rolling characteristics. Rolling is abnormal vibration causing the diaphragm to rotate. By reducing the distance between a barycenter of a vibration system from a fixed point (line, surface) of the support system as much as possible, it is possible to enhance the advantageous effect of minimizing and suppressing rotational moment of the vibration system.

The voice coil 120 of the loudspeaker 100 is arranged inside a toric cross section of the diaphragm 110 and on the central plane (surface of X-X' in FIG. 1B) of the diaphragm 110 orthogonal to the vibration direction. In addition, the fixed point on the frame 160 of the edge 150, a barycenter of the diaphragm 110, and a barycenter of the magnetic circuit 140 are also arranged on the central plane (surface of X-X' in FIG. 1B). As a result of this arrangement, since the position of a barycenter of the vibration system and the position of the fixed point of the support system are also placed on the same plane, it is possible to have a loudspeaker with excellent anti-rolling characteristics.

As a result of the above described configuration, the loudspeaker 100 can have a thin long structure, achieve improved rigidity by having a characteristic overall configuration as a loudspeaker and a characteristic diaphragm shape, and have a reduced overall thickness as a loudspeaker. In addition, this overall loudspeaker configuration results in an additional advantageous effect of having improved anti-rolling characteristics through suppression of abnormal vibration.

Embodiment 2

In the following, description of a loudspeaker 200 according to Embodiment 2 will be provided. The loudspeaker 200 is obtained by adding, to the loudspeaker 100 of Embodiment 1, a voice coil lead line attached inside the diaphragm 110.

Figure 9A:
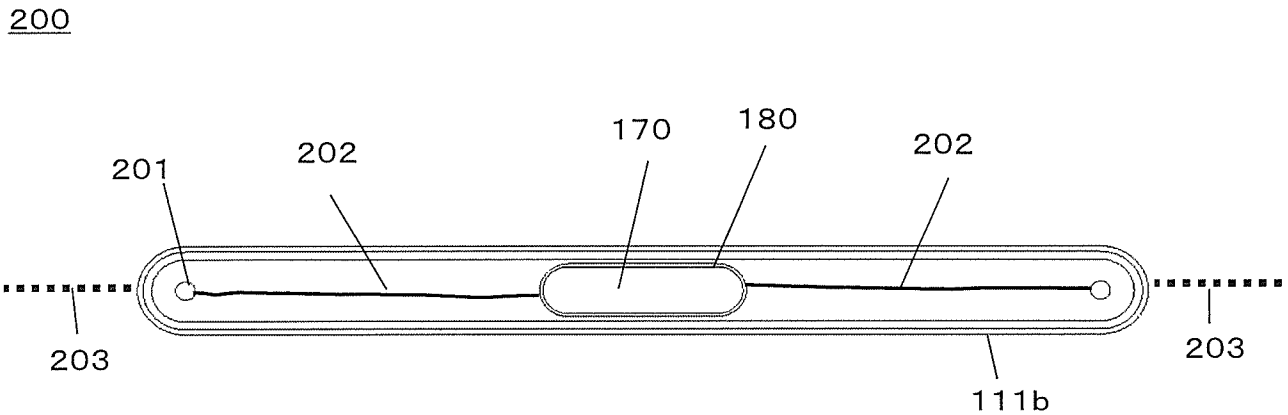
FIG. 9A is a top view of a diaphragm in Embodiment 2.
Figure 9B:
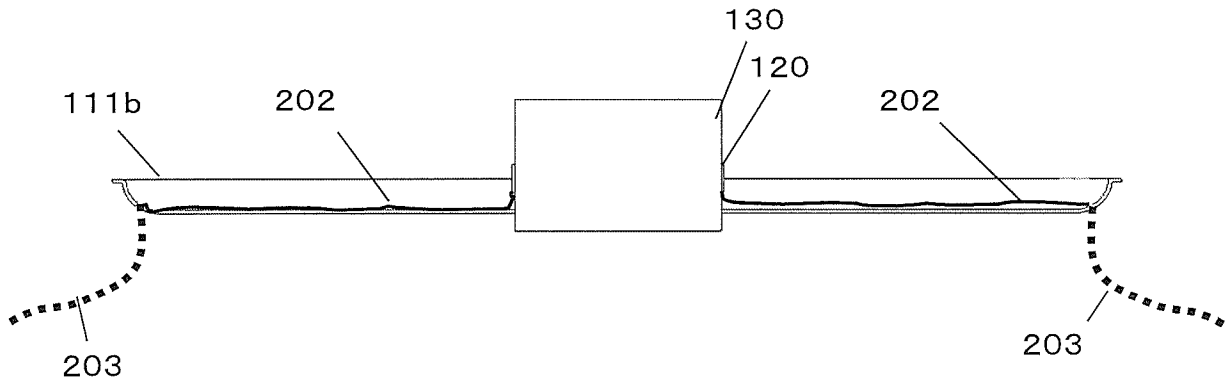
FIG. 9B is a cross sectional view in a long side direction of the diaphragm in Embodiment 2.

FIG. 9A is a top view of the loudspeaker 200. FIG. 9B is a schematic diagram of a cross section cut in a long side direction in FIG. 9A. It should be noted that the diaphragm 111*a* on the top side of the diaphragm 110 is not shown in FIG. 9A and FIG. 9B. Eyelets 201 are secured at terminal parts of the diaphragm 111*b* on the bottom side in the long side direction, and are integral structure of the diaphragm 111*b* on the bottom side. Conductive lines 203 are attached to the eyelets 201, and end portions of the conductive lines 203 on the opposite sides of the eyelets 201 are connected to terminals (not shown) that are disposed on the frame (not shown) and from which signals for driving the loudspeaker are inputted. As the conductive lines 203, for example, a gold thread line or the like can be used.

The voice coil 120 is attached on a center line of the diaphragm 111*b* in the long side direction via the voice coil bobbin 130. Lead lines 202 of the voice coil 120 are attached on the inner side surface of the diaphragm 111*b*. The lead lines 202 are electrically connected to the conductive lines 203 connected to the eyelets 201. The diaphragm 111*a* and the diaphragm 111*b* having the wiring are attached together to form a cylindrical shape to achieve the loudspeaker 200 having similar magnetic circuit and frame configuration as in Embodiment 1.

Next, description will be provided regarding the motion and advantageous effect of the loudspeaker 200 formed as described above. The basic motion thereof is similar to that in Embodiment 1. An electric circuit is formed in which driving signals inputted to a terminal of the frame 160 travel through one of the conductive line 203, one of the eyelets 201, one of the lead lines 202, the voice coil 120, the other lead line 202, the other eyelet 201, the other conductive line 203, and reach a terminal formed on the frame 160. As a result, the voice coil 120 generates force corresponding to signals inputted to the loudspeaker, and causes the diaphragm 110 to vibrate. Since the lead lines 202 are attached on the inner surface of the diaphragm 111*b*, when the diaphragm 110 moves, the lead lines 202 vibrate together with the diaphragm 110. A thin long diaphragm may generate abnormal resonance due to having a lengthy lead line, or result in disconnection of a line due to resonance vibration. With the loudspeaker 200, it is possible provide an excellent loudspeaker without any distortions by preventing disconnection of the lead lines 202 due to abnormal resonance and resonance vibration. In addition, by having wiring between the frame 160 and the diaphragm 110 with a long and thin shape, an advantageous effect of reducing possibility of electrical contact with the frame 160 can be obtained. Similarly, since it is not necessary to provide space larger than a vibrational amplitude margin for preventing contact with the frame 160, it is possible to reduce the thickness of the loudspeaker.

Embodiment 3

Figure 10A:
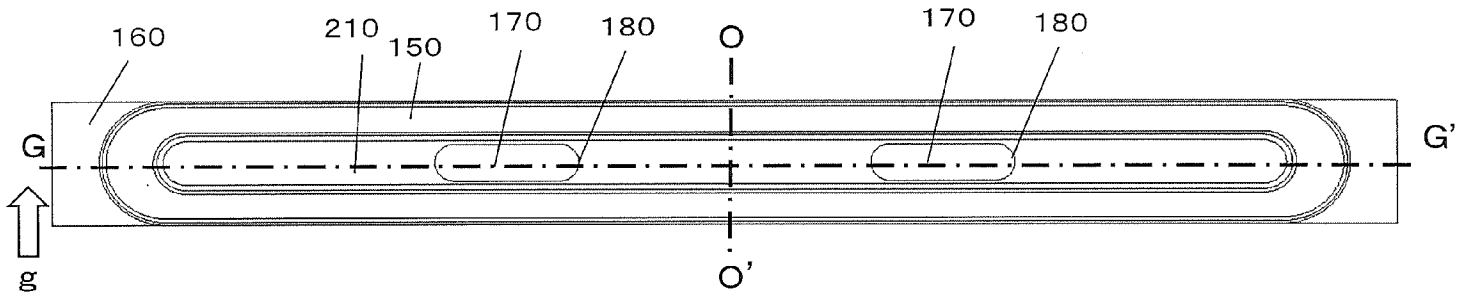
FIG. 10A is a top view of a loudspeaker according to Embodiment 3.
Figure 10B:
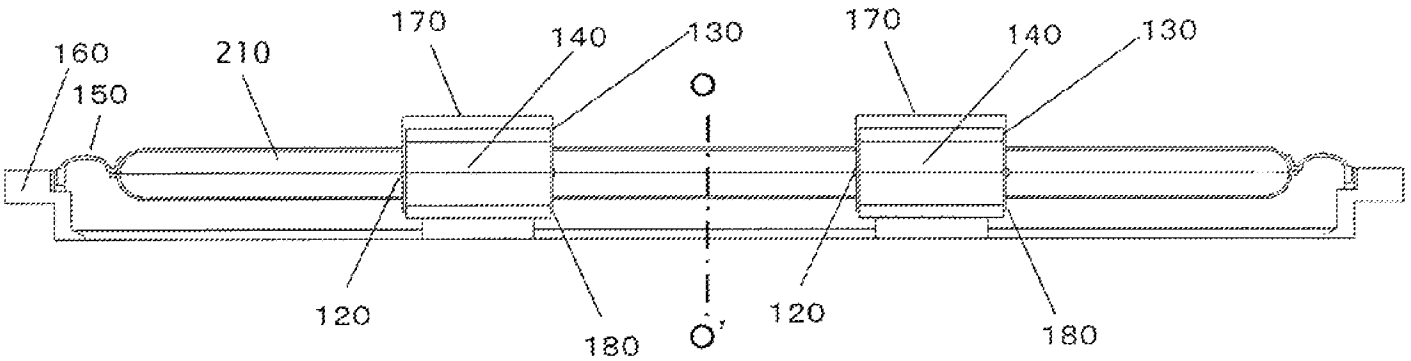
FIG. 10B is a schematic diagram of a cross section cut along line G-G' in FIG. 10A.

In the following, description of Embodiment 3 will be provided. FIG. 10A is a top view of a loudspeaker 300 according to the present embodiment. FIG. 10B is a schematic diagram of a cross section cut along line G-G' in FIG. 10A and viewed from a direction of arrow g.

In order to have two of the voice coil bobbins 130 included in the loudspeaker 100 according to Embodiment 1, the loudspeaker 300 has a diaphragm 210 having two of the penetration holes 180, and the voice coil bobbins 130 are attached via the two penetration holes 180.

Next, description will be provided regarding driving position of the diaphragm. The driving position is configured by taking into consideration the band of the loudspeaker. In the conventional loudspeaker 1000 having a thin long structure or the loudspeaker 100 according to Embodiment 1, the center of the diaphragm 1008 or 110 in the long side direction is the driving point, and the single voice coil 1006 or the single voice coil 120 is placed. When there is no resonance of the diaphragm 1008 or 110 in the used frequency band, i.e., when reproduction is focused on low frequency, the above described structure is sufficient. In this case, the diaphragm vibrates as a piston up to the primary resonance frequency.

However, in order to further smoothen the sound-pressure frequency characteristics, it is necessary to suppress the resonance mode that is generated. Therefore, in order to suppress the primary resonance mode that is generated first, and achieve smooth characteristics also in the secondary resonance mode that is generated next, the loudspeaker 300 has two driving points (voice coils). The driving points for controlling the primary resonance mode are suitably set at positions of the nodes in the primary resonance mode. When rigidity of the diaphragm 210 is higher when compared to that of the edge 150 and when mass of the edge 150 is light as the diaphragm 210, the resonance style of the diaphragm 210 becomes approximately similar to the resonance style of a rod whose ends on both sides are free. Therefore, the positions of the nodes of the primary resonance mode in the long side direction of the diaphragm 210 are located at, when the length of the diaphragm 210 in the long side direction is defined as 1, positions corresponding to 0.224 and 0.776 from the long side direction end of the diaphragm 210. Thus, the voice coil bobbins 130 are suitably attached at positions where the nodes of the primary resonance mode in the long side direction of the diaphragm 210 are located, i.e., at positions corresponding to 0.224 and 0.776 from the long side direction end of the diaphragm 210 when the length of the diaphragm 210 in the long side direction is defined as 1. When the primary resonance mode is suppressed, the band is broadened approximately 4 times of the frequency. In the case of FIG. 8, the primary resonance mode is suppressed and can be broadened to the frequency of the following second resonance mode. Therefore, with the present embodiment, reproduction frequency can be increased when compared to Embodiment 1.

In addition, in the loudspeaker 300 according to the present embodiment, broadening of the reproduction frequency band is achieved by the number of driving points that are set, not by changing the thickness of the loudspeaker.

Embodiment 4

Figure 11A:
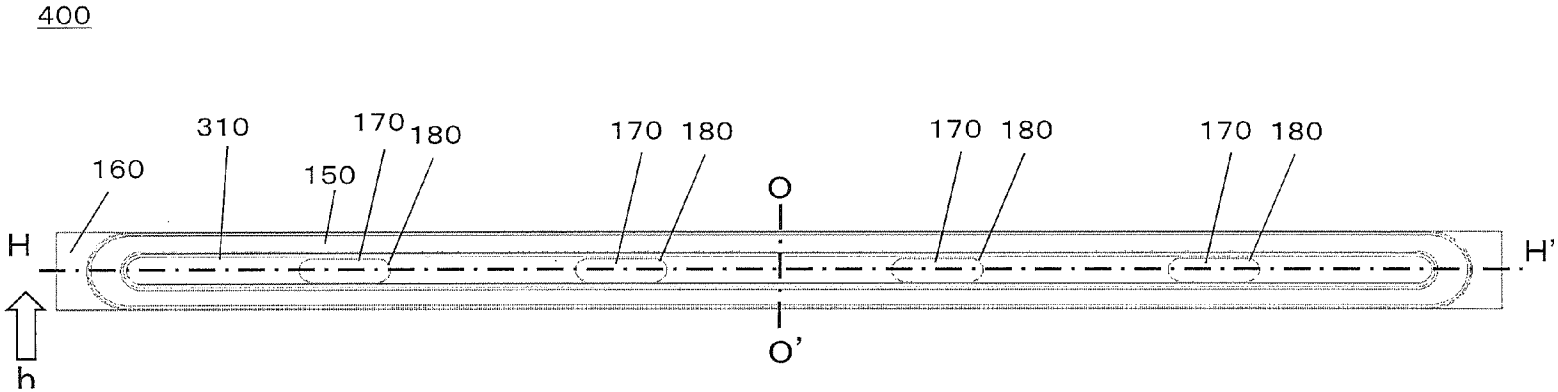
FIG. 11A is a top view of the loudspeaker according to Embodiment 3.
Figure 11B:
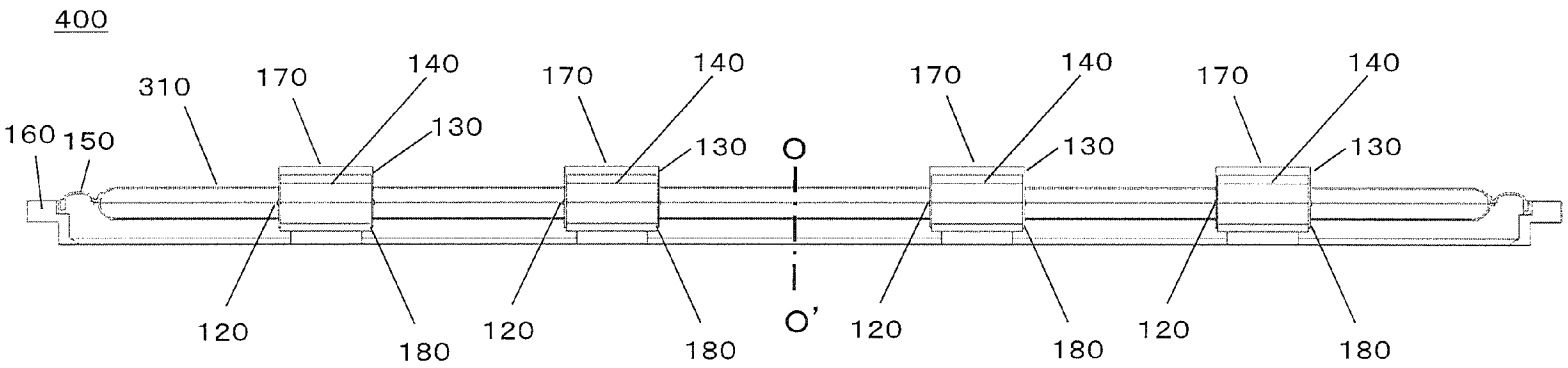
FIG. 11B is a schematic diagram of a cross section cut along line H-H' in FIG. 11A.

In the following, description of Embodiment 4 will be provided. FIG. 11A is a top view of a loudspeaker 400 according to the present embodiment. FIG. 11B is a schematic diagram of a cross section cut along line H-H' in FIG. 11A and viewed from a direction of arrow h.

In order to additionally have two more of the voice coil bobbins 130 included in the loudspeaker 300 according to Embodiment 3, the loudspeaker 400 has a diaphragm 310 having four of the penetration holes 180, and the voice coil bobbins 130 are attached via the four penetration holes 180.

When the number of driving points is four, and when the driving points are placed at positions for suppressing both the primary and secondary resonance modes as in the case with the loudspeaker 400, the band is further broadened. If an assumption similar for the primary resonance mode is used, and when the length of the diaphragm 110 in the long side direction is defined as 1, the voice coil bobbins 130 are suitably attached to positions corresponding to $x1=0.1130$, $x2=0.37775$, $x3=(1-x2)=0.62225$, and $x4=(1-x1)=0.8870$. When the number of driving points is four as described above, a loudspeaker that has a markedly wide reproduction band and makes a piston motion without generating resonance can be formed.

Figure 12A:
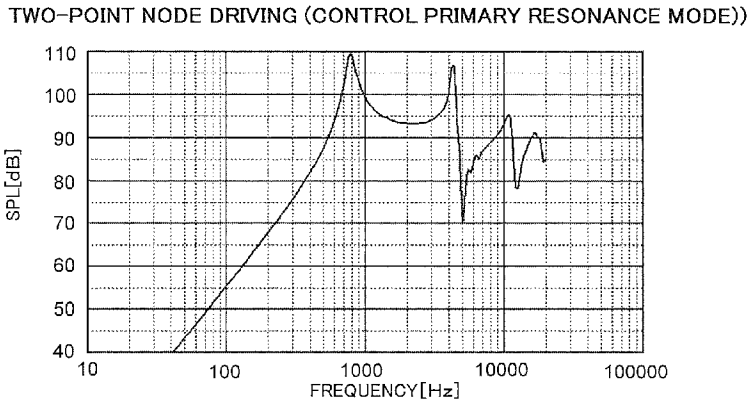
FIG. 12A is a characteristic diagram in the case of two-point driving in which primary resonance mode is controlled.
Figure 12B:
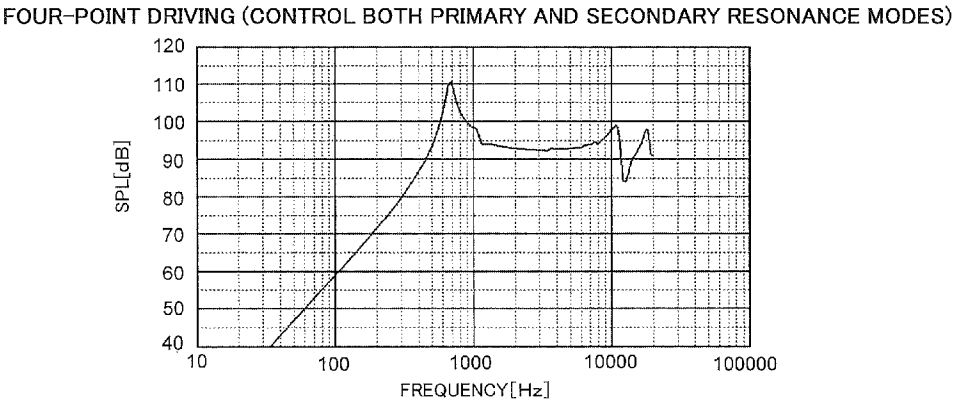
FIG. 12B is a characteristic diagram in the case of four-point driving in which both the primary and secondary resonance modes are controlled.
Figure 12C:
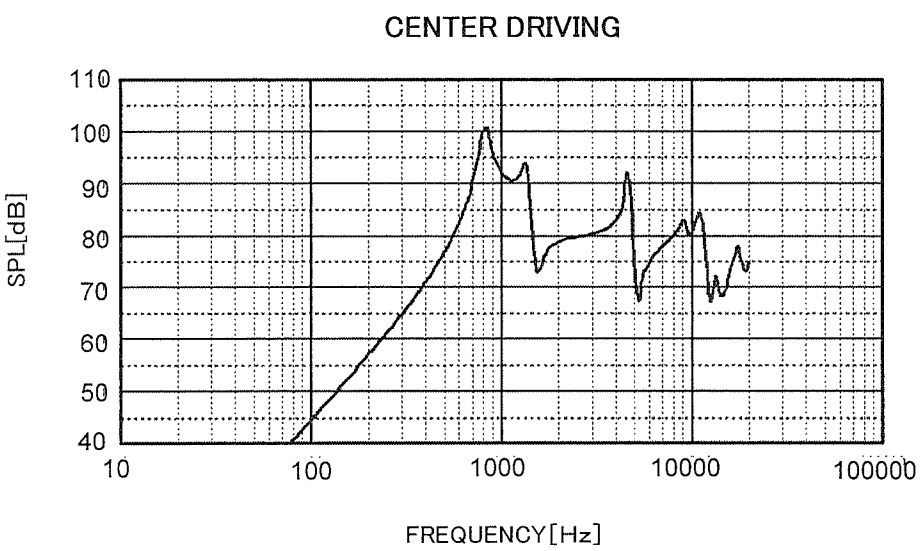
FIG. 12C is a characteristic diagram in the case of center driving.

FIG. 12A shows the sound-pressure frequency characteristics when driving is conducted at positions of the nodes of the primary resonance mode (two-point driving). Furthermore, FIG. 12B shows the sound-pressure frequency characteristics when the four voice coils are placed at positions for suppressing both the primary and secondary resonance modes (four-point driving). In addition, FIG. 12C shows the sound-pressure frequency characteristics when driving is conducted at the center. From a comparison of FIG. 12A, FIG. 12B, and FIG. 12C, it can be understood that, by creatively setting the number and positions of driving points, the resonance mode is suppressed and reproduction frequency band is broadened.

In addition, similar to the loudspeaker 300 according to Embodiment 3, in the loudspeaker 400 according to present embodiment, broadening of the reproduction frequency band is achieved by the number of driving points that are set, not by changing the thickness of the loudspeaker.

Embodiment 5

Figure 13:
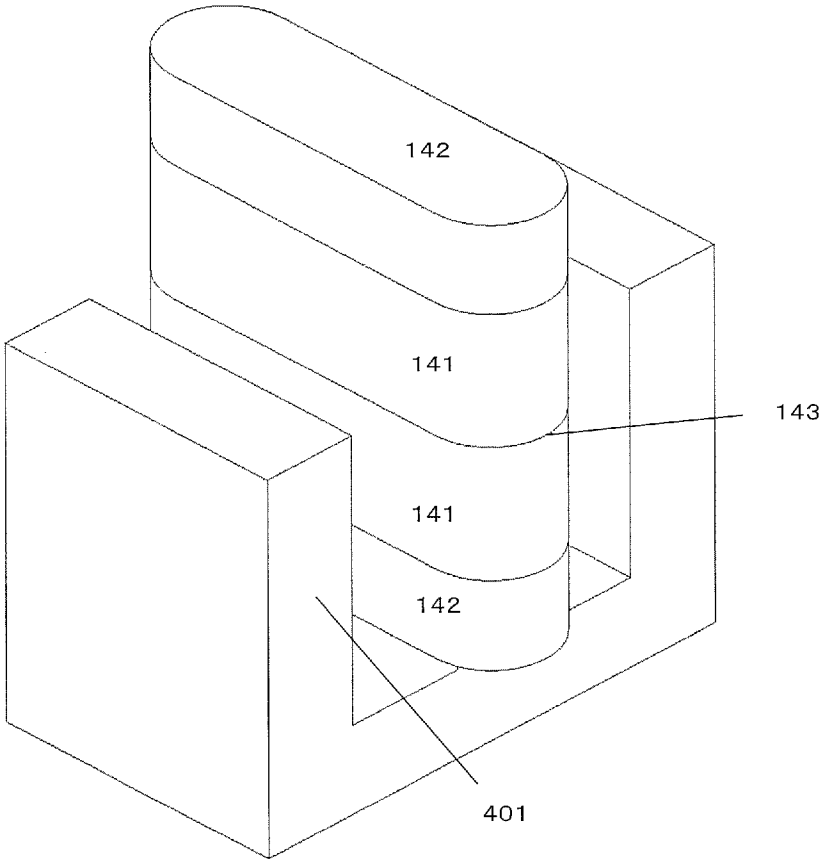
FIG. 13 is a perspective view of a magnetic circuit in Embodiment 5.
Figure 14:
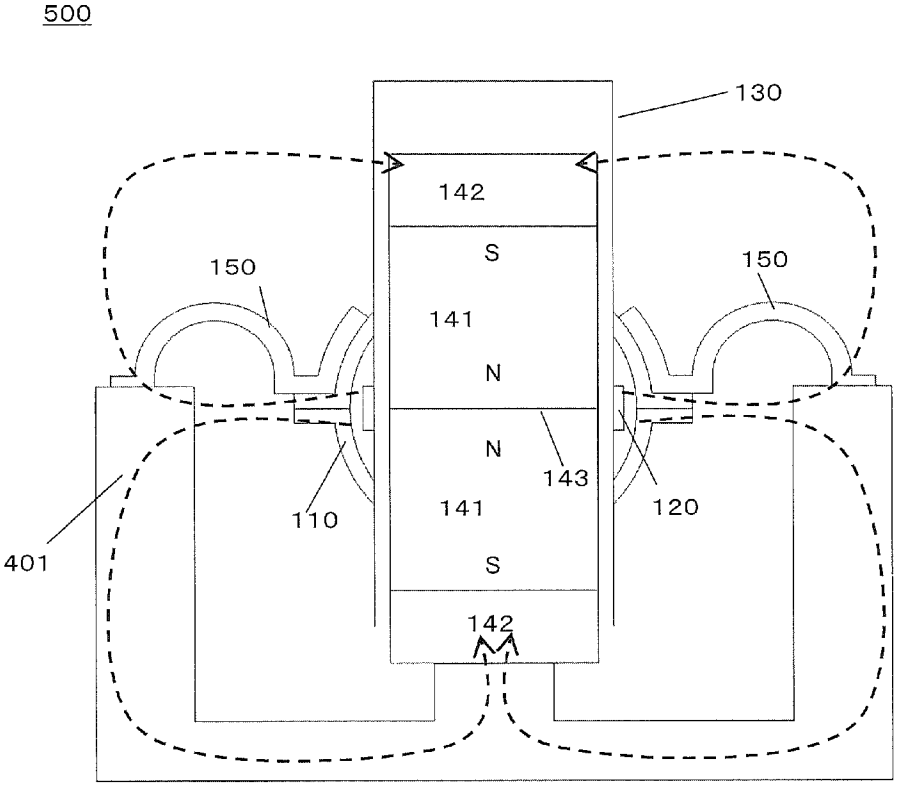
FIG. 14 is a cross sectional view in a short side direction of the loudspeaker in Embodiment 5.

In the following, description of a loudspeaker 500 according to Embodiment 5 will be provided. FIG. 13 is a perspective view of a magnetic circuit 540 used in the loudspeaker 500. In addition, FIG. 14 is a cross sectional view of the loudspeaker 50) in the short side direction.

The magnetic circuit 540 has a structure obtained by further placing, in the magnetic circuit 140 according to Embodiment 1, an auxiliary plate 401 surrounding both sides of the joint surface 143 of the magnets 141. The auxiliary plate 401 is adhered on an end surface of one of the plates 142, and surrounds both sides of the joint surface 143 of the magnets 141 outside the diaphragm 110. In FIG. 14, letters N and S show one example of the polarization direction of the magnets 141. The polarities of N and S are set to obtain mutual repelling polarities, and are reversible.

Next, description will be provided regarding the motion and advantageous effect of the loudspeaker 500 formed as described above. FIG. 14 shows the flow of magnetic flux with dashed arrows. The generated magnetic flux emerges from the joint surface 143 of one of the magnets 141 in the horizontal direction, and reaches the plates 142 while repelling other magnetic flux emerged from the other magnet 141 in a mutual manner. In this case, the auxiliary plate 401 forms the magnetic circuit in the loudspeaker 500. Magnetic flux generated by the magnets 141 emerges from the joint surface 143 in the horizontal direction, and then reaches the auxiliary plate 401. Next, the magnetic flux travels within the auxiliary plate and reaches the plates 142. As a result, magnetic flux having a component perpendicular to the direction in which current flows through the coil wire interlinked with the voice coil 120 increases.

Furthermore, similar to Embodiment 1, when current is applied to the voice coil 120, driving force is generated on the voice coil 120 by the applied current and magnetic field created by magnetic circuit. The generated driving force is transferred to the diaphragm 110 via the voice coil bobbin 130. Vibration of the diaphragm 110, to which the driving force is transferred, causes sound to radiate to external space.

As described above, since magnetic flux interlinked with the voice coil 120 increases in the loudspeaker 500, it is possible to achieve a loudspeaker capable of reproducing a large sound with higher sound pressure. More specifically, by suitably utilizing the structure in which the magnetic circuit is buried in the diaphragm and having the auxiliary plate 401, it is possible to increase the magnetic flux and improve sound pressure without more space.

Embodiment 6

Figure 15:
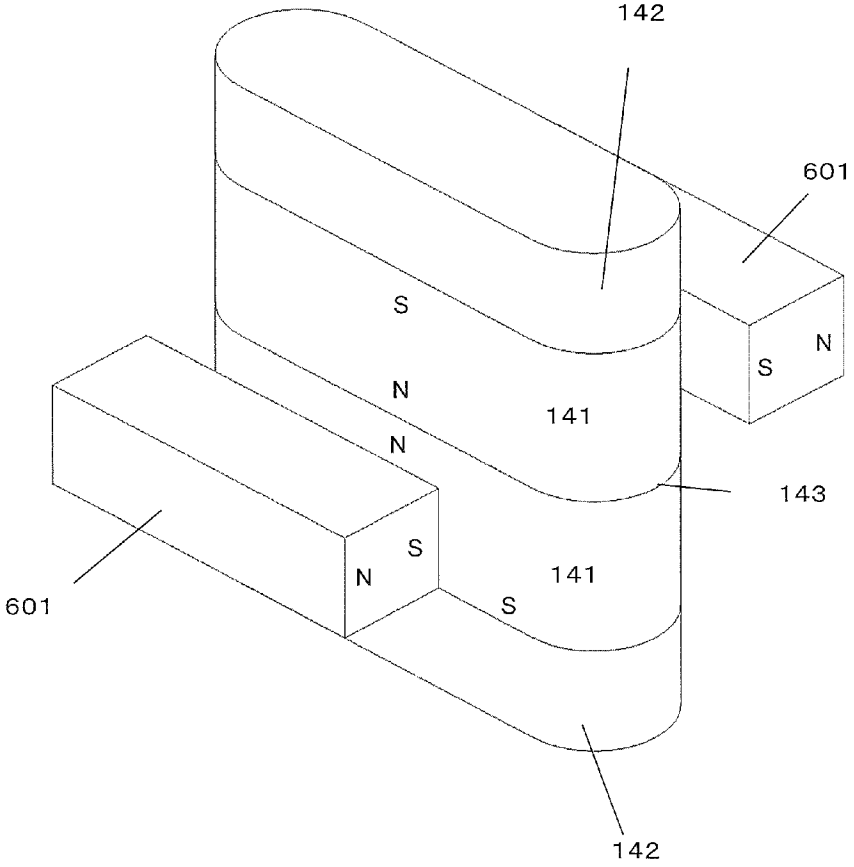
FIG. 15 is a perspective view of a magnetic circuit in Embodiment 6.
Figure 16:
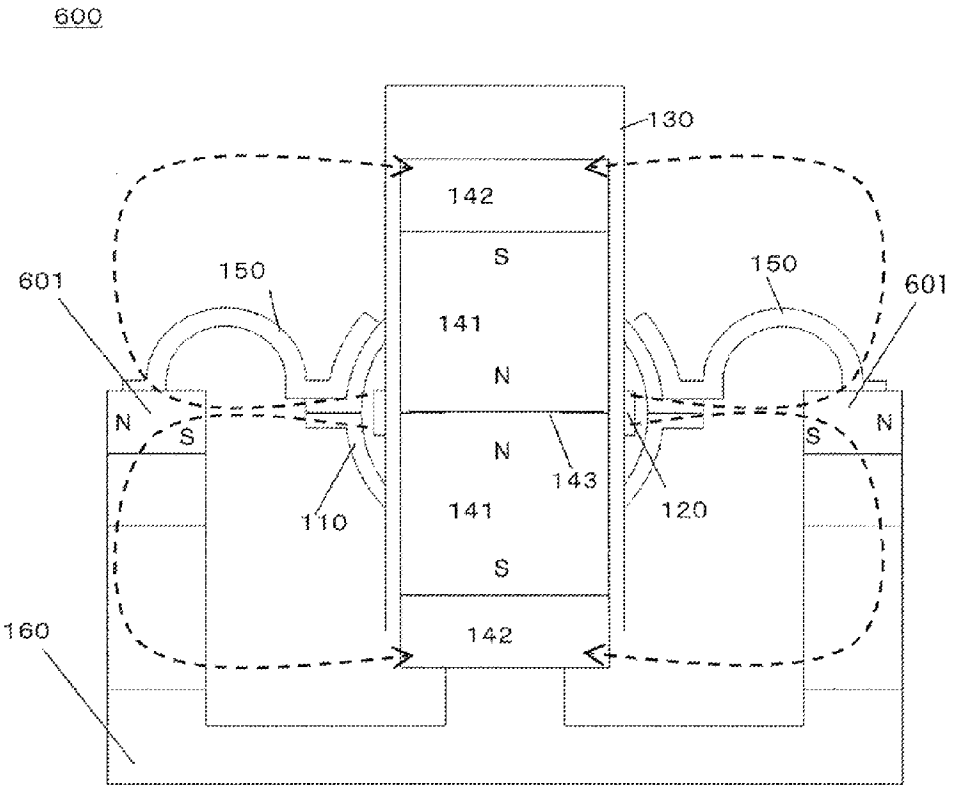
FIG. 16 is a cross sectional view in a short side direction of the loudspeaker in Embodiment 6.
Figure 17:
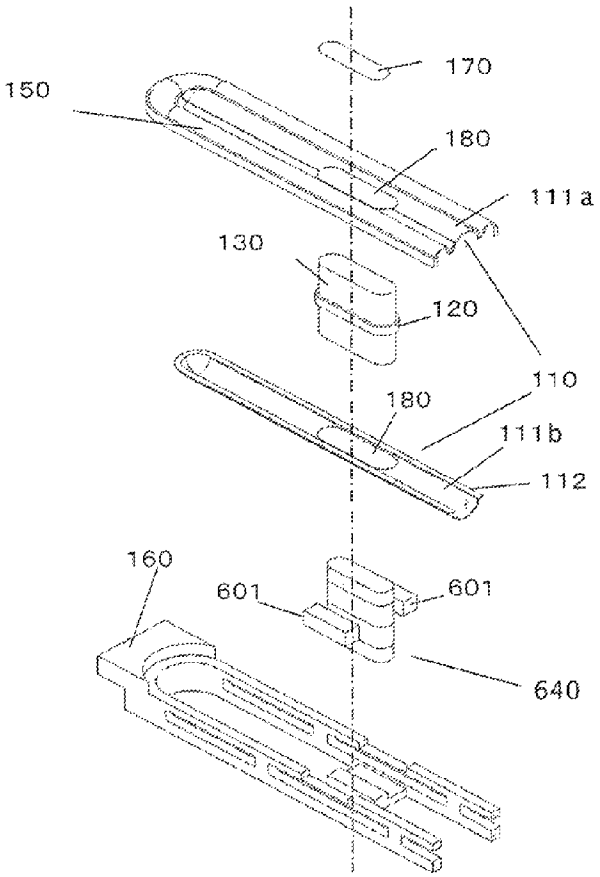
FIG. 17 is a component constitution perspective view of the loudspeaker in Embodiment 6.

In the following, description of a loudspeaker 600 according to Embodiment 6 will be provided. FIG. 15 is a perspective view of a magnetic circuit 640 used in the loudspeaker 600. In addition, FIG. 16 is a cross sectional view of the loudspeaker 600 in the short side direction. Furthermore, FIG. 17 is an outline view of the component constitution of the loudspeaker 600.

The magnetic circuit 640 has a structure obtained by further placing, in the magnetic circuit 140 according to Embodiment 1, auxiliary magnets 601 on both sides of the joint surface 143 of the magnets 141.

The auxiliary magnets 601 are attached to the frame 160 at positions and disposed on the side surfaces of the joint surface 143 separately from the diaphragm 110. The polarization direction of the auxiliary magnets 601 is a direction orthogonal to the magnets 141, and the auxiliary magnets 601 are polarized such that S pole is facing the joint surface 143 when the joint surface 143 is polarized to be N pole, and that N pole is facing the joint surface 143 when the joint surface 143 is polarized to be S pole. In FIG. 16, letters N and S show one example of the polarization directions of the magnets 141 and the auxiliary magnets 601. The polarities of N and S are set to obtain mutual repelling polarities, and are reversible.

Next, description will be provided regarding the motion and advantageous effect of the loudspeaker 600 formed as described above. FIG. 16 shows the flow of magnetic flux with dashed arrows. The generated magnetic flux emerges from the joint surface 143 of the magnets 141 in the horizontal direction, is joined by magnetic flux that has emerged from the auxiliary magnets 601, and reaches the plates 142 while repelling other magnetic flux in a mutual manner. As a result, magnetic flux having a component perpendicular to the direction in which current flows through the coil wire interlinked with the voice coil 120 increases.

Furthermore, similar to Embodiment 1, when current is applied to the voice coil 120, driving force is generated on the voice coil 120 by the applied current and magnetic field created by magnetic circuit. The generated driving force is transferred to the diaphragm 110 via the voice coil bobbin 130. Vibration of the diaphragm 110, to which the driving force is transferred, causes sound to radiate to external space.

As described above, since magnetic flux interlinked with the voice coil 120 increases in the loudspeaker 600, it is possible to achieve a loudspeaker capable of reproducing a large sound with higher sound pressure. More specifically, by suitably utilizing the structure in which the magnetic circuit is buried in the diaphragm and placing the auxiliary magnets 601, it is possible to increase the magnetic flux and improve sound pressure without more space. In addition, similar to Embodiment 4, the auxiliary plate 401 may be provided, and the auxiliary magnets 601 may be disposed on the auxiliary plate 401. With this, it is possible to further increase the magnetic flux and improve sound pressure without more space.

Other Embodiments

Embodiments 1 to 6 have been illustrated as an example of implementation of the present disclosure. However, the present disclosure is not limited thereto, and embodiments with modifications, replacements, additions, and omissions made as appropriate are also applicable. Furthermore, since the loudspeakers described in Embodiments 1 to 6 can easily achieve reduction in thickness, the loudspeakers can be used in electronic equipment such as thin-screen televisions, mobile phones, and PDAs. Thus, the electronic equipment may include a loudspeaker according to the present disclosure, and a housing retaining the loudspeaker therein. Therefore, another embodiment will be illustrated in the following.

Figure 18:
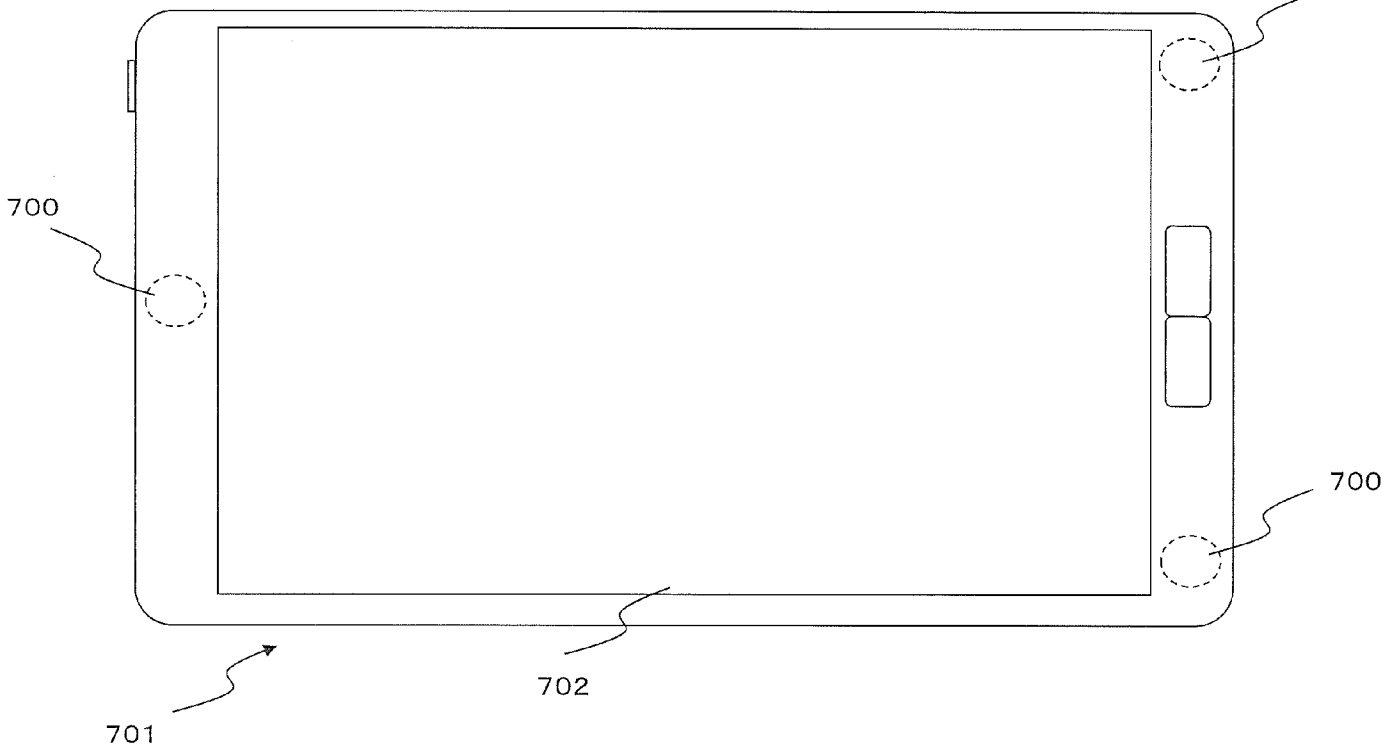
FIG. 18 shows a mobile information terminal device.

FIG. 18 shows a mobile information terminal device 701 having mounted therein a loudspeaker selected from those shown in Embodiments 1 to 6 of the present disclosure. In FIG. 18, 702 indicates a screen, and 700 indicates a loudspeaker selected from those shown in Embodiments 1 to 6. Although loudspeakers 700 are disposed at three locations in FIG. 18, there may be any number of the loudspeakers as long as there is at least one. The device reproduces monophonically if the number of loudspeaker devices is one, stereophonically if the number of loudspeaker devices is two, and can be used as a device for HRTF or sound field control if the number of loudspeaker devices is two or more. When the loudspeakers 700 are mounted in an apparatus with limited mounting capacity as in the case with the mobile information terminal device 701, stable reproduction in a broad band becomes possible even with limited capacity. Regarding the mount direction of the loudspeakers 700 when being mounted with respect to a sound hole provided on a housing, it is possible to arrange the diaphragm so as to be directed toward the sound hole side or arrange the frame so as to be directed toward the sound hole side.

Figure 19:
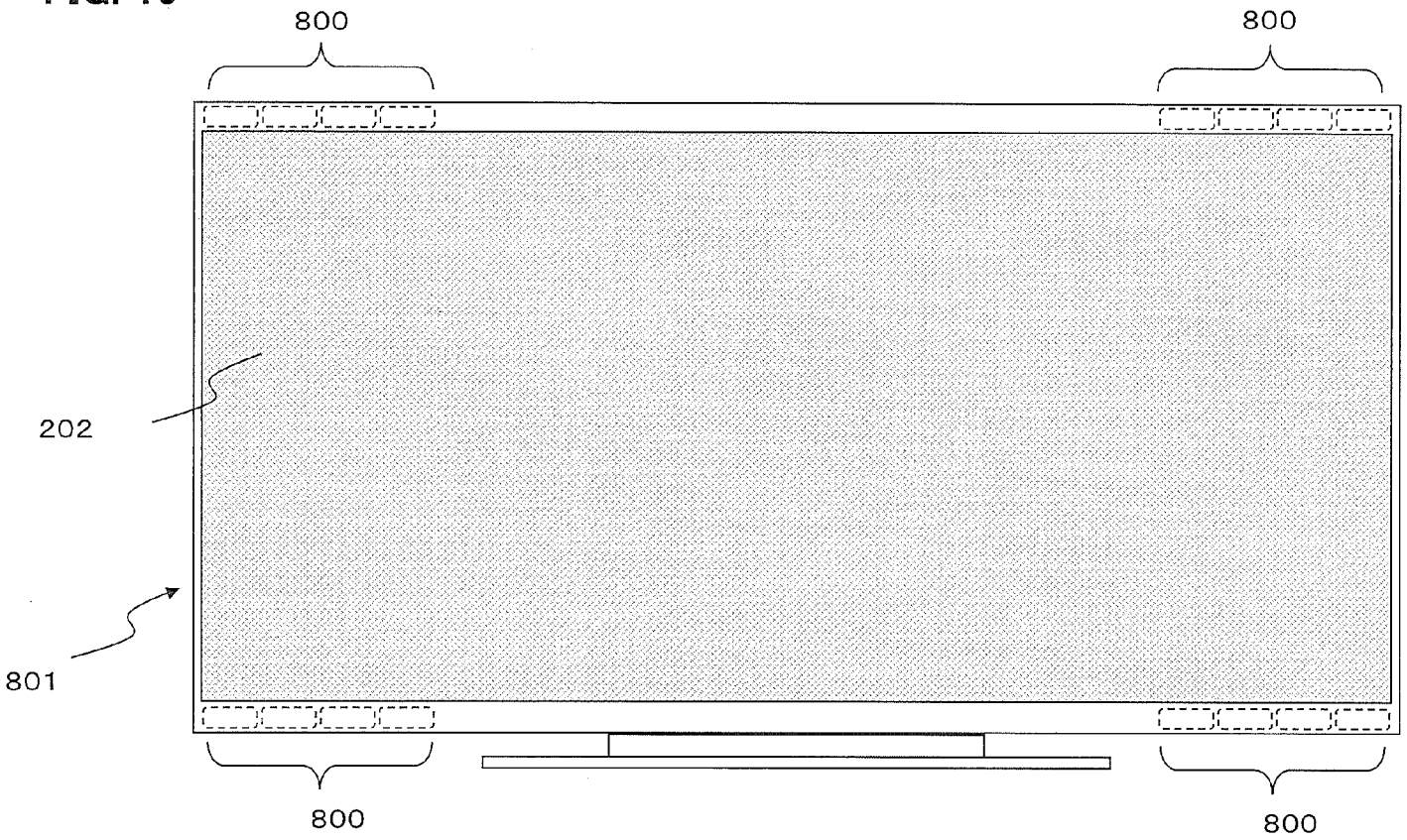
FIG. 19 shows an image display device.

In addition, FIG. 19 shows an image display device 801 having mounted therein a loudspeaker selected from those shown in Embodiments 1 to 6 of the present disclosure. More specifically, the image display device 801 is a PC or a thin-screen TV. In FIG. 19, 202 indicates a screen, and 800 indicates a loudspeaker selected from those shown in Embodiments 1 to 6. Although loudspeakers 800 are disposed at 16 locations in FIG. 19, there may be any number of the loudspeakers 800 as long as there is at least one. The device reproduces monophonically if the number of loudspeaker devices is one, stereophonically if the number of loudspeaker devices is two, and can be used as a device for HRTF or sound field control (e.g., when arranged as a line array) if the number of loudspeaker devices is two or more. When the loudspeakers 800 are mounted in an apparatus with limited mounting capacity as in the case with the image display device 801, stable reproduction in a broad band is possible even with limited capacity. Regarding the mount direction of the loudspeakers 800 when being mounted with respect to a sound hole provided on a housing, it is possible to arrange the diaphragm so as to be directed toward the sound hole side or the frame so as to be directed toward the sound hole side.

Figure 20:
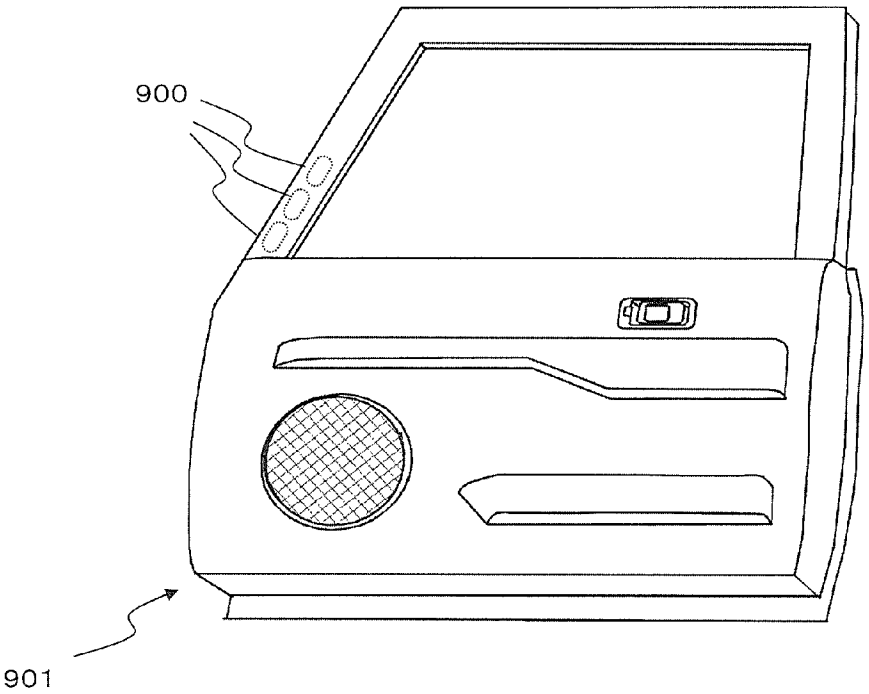
FIG. 20 shows a mounted view of a car-mounted loudspeaker.

FIG. 20 is a mounted view of a car-mounted loudspeaker. In FIG. 20, 901 indicates a door of an automobile, 900 indicates a loudspeaker selected from those shown in Embodiments 1 to 6 of the present disclosure. Although loudspeakers 900 are disposed at three locations in FIG. 20, there may be any number of the loudspeakers 900 as long as there is at least one. In addition, although FIG. 20 shows an example in which the loudspeakers 900 are attached to a door 901 of the automobile, the loudspeakers 900 may be attached to any location of the automobile such as a dashboard, pillar, seat, headrest, or ceiling of the automobile. Furthermore, other than an automobile, the loudspeaker may be attached to other moving means such as trains, monorail trains, linear motor trains, airplanes, and ships. Conventionally, it has been necessary to have a large size loudspeaker for reproduction in a broad band, in particular, reproduction of low pitch sounds. The loudspeakers shown in Embodiments 1 to 6 of the present disclosure can achieve a thin loudspeaker when compare to conventional loudspeakers. As a result, reduction in overall size of the moving means is achieved, and it becomes possible to improve comfort by increasing residential space. It should be noted that, regarding the mount direction of the loudspeaker with respect to a sound hole provided on a housing when being mounted, it is possible to arrange the diaphragm so as to be directed toward the sound hole side or the frame so as to be directed toward the sound hole side.

INDUSTRIAL APPLICABILITY

The loudspeakers according to the present disclosure can be used for electronic equipment such as thin-screen televisions, mobile phones, and PDAs.

DESCRIPTION OF THE REFERENCE CHARACTERS

100, 200, 300, 400, 500, 600, 700, 800, 900 loudspeaker
110, 111*a*, 111*b*, 210, 310, 610 diaphragm
112 adhesion margin
120 voice coil
130 voice coil bobbin
140, 540, 640 magnetic circuit
141 magnet
142 plate
143 joint surface
150 edge
160 frame
170 dust cap
180 penetration hole
202 lead line
203 conductive line
401 auxiliary plate
601 auxiliary magnets
701 mobile information terminal device
702 screen
801 image display device
901 automobile door

The invention claimed is:

1. A loudspeaker having a thin long structure, the loudspeaker comprising:
a frame;
a diaphragm having a hollow structure and in which a shape of a plane that is perpendicular to a vibration direction is an oblong shape having a long side and a short side;
an edge vibratably supporting the diaphragm and being fixed to the frame;
at least one cylinder-shaped voice coil bobbin connected to the diaphragm in a penetrating manner;
a voice coil disposed inside the hollow structure of the diaphragm and attached to the voice coil bobbin;
a magnetic circuit disposed inside the voice coil bobbin and configured to drive the voice coil;
a conductive line connecting a terminal disposed on the frame and an eyelet secured at a terminal part of the diaphragm in a long side direction thereof; and
a lead line connecting the eyelet and the voice coil, wherein the lead line is attached inside the diaphragm.

2. The loudspeaker according to claim 1, wherein the voice coil is attached so as to be arranged at a position that equally divides a height of the voice coil bobbin.

3. The loudspeaker according to claim 2, wherein a barycenter of the voice coil, a point at which the edge is fixed to the frame, a barycenter of the diaphragm, and a barycenter of the magnetic circuit are arranged on an identical plane.

4. The loudspeaker according to claim 1, wherein the magnetic circuit has a configuration in which two magnets are attached to each other in a repelling direction.

5. The loudspeaker according to claim 1, wherein a cross-sectional shape in a short side direction of the diaphragm is a circular shape, an elliptical shape, a hollow trapezoidal shape, or a hollow polygonal shape.

6. A loudspeaker having a thin long structure, the loudspeaker comprising:
a frame;
a diaphragm having a hollow structure and in which a shape of a plane that is perpendicular to a vibration direction is an oblong shape having a long side and a short side;
an edge vibratably supporting the diaphragm and being fixed to the frame;
two cylinder-shaped voice coil bobbins connected to the diaphragm in a penetrating manner;
two voice coils disposed inside the hollow structure of the diaphragm and respectively attached to the voice coil bobbins; and
two magnetic circuits respectively disposed inside the voice coil bobbins and configured to respectively drive the voice coils, wherein
the voice coil bobbins are each disposed at a position of a node in a primary resonance mode in a long side direction of the diaphragm.

7. The loudspeaker according to claim 6, wherein
when one end of the diaphragm in the long side direction is defined as 0 and another end is defined as 1, and
the voice coil bobbins are disposed at positions corresponding to 0.224 and 0.776.

8. A loudspeaker having a thin long structure, the loudspeaker comprising:
a frame;
a diaphragm having a hollow structure and in which a shape of a plane that is perpendicular to a vibration direction is an oblong shape having a long side and a short side;
an edge vibratably supporting the diaphragm and being fixed to the frame;
four cylinder-shaped voice coil bobbins connected to the diaphragm in a penetrating manner;

four voice coils disposed inside the hollow structure of the diaphragm and respectively attached to the voice coil bobbins; and four magnetic circuits respectively disposed inside the voice coil bobbins and configured to respectively drive the voice coils, wherein the voice coil bobbins are each disposed at a position of a node in a primary resonance mode and a secondary resonance mode in a long side direction of the diaphragm.

9. The loudspeaker according to claim 8, wherein when one end of the diaphragm in the long side direction is defined as 0 and another end is defined as 1, the voice coil bobbins are disposed at positions of 0.1130, 0.37775, 0.62225, and 0.8870.

10. The loudspeaker according to claim 1, further comprising an auxiliary plate disposed outside the diaphragm so as to surround both sides of the magnetic circuit in the long side direction of diaphragm.

11. The loudspeaker according to claim 1, further comprising auxiliary magnets disposed separately from the diaphragm at positions on both sides of the magnetic circuit in the long side direction of the diaphragm.

12. The loudspeaker according to claim 1, wherein a shape of both ends of the diaphragm in the long side direction is a semi-spherical shape.

13. An electronic equipment comprising the loudspeaker according to claim 1.

* * * * *